US005422214A

United States Patent [19]

Akiyama et al.

[11] Patent Number: 5,422,214

[45] Date of Patent: Jun. 6, 1995

[54] DRY TONER FOR DEVELOPING ELECTROSTATIC LATENT IMAGE, PROCESS FOR PRODUCING SAME, AND IMAGE FORMATION PROCESS USING SAME

[75] Inventors: Reiko Akiyama, Edwardsville, Ill.; Chiaki Suzuki, Minami-ashigara, Japan; Atuhiko Eguchi, Minami-ashigara, Japan; Takayoshi Aoki, Minami-ashigara, Japan

[73] Assignee: Fuji Xerox Co., Ltd., Tokyo, Japan

[21] Appl. No.: 14,736

[22] Filed: Feb. 8, 1993

[30] Foreign Application Priority Data

Feb. 14, 1992 [JP] Japan ..... 4-059202

[51] Int. Cl.[6] ..... G03G 9/083; G03G 9/107

[52] U.S. Cl. ..... 430/106.6; 430/111; 430/137

[58] Field of Search ..... 430/106.6, 111, 137, 430/903

[56] References Cited

U.S. PATENT DOCUMENTS

| | | | |
|---|---|---|---|
| 5,137,796 | 8/1992 | Takiguchi et al. | 430/106.6 |
| 5,158,852 | 10/1992 | Sakata et al. | 430/106.6 |
| 5,223,365 | 6/1993 | Yamamoto et al. | 430/106.6 |

FOREIGN PATENT DOCUMENTS

| | | |
|---|---|---|
| 55-12977 | 1/1980 | Japan . |
| 56-51755 | 5/1981 | Japan . |
| 59-187347 | 10/1984 | Japan . |
| 59-226355 | 12/1984 | Japan . |
| 60-121457 | 6/1985 | Japan . |
| 60-166959 | 8/1985 | Japan . |
| 60-198556 | 10/1985 | Japan . |
| 61-23160 | 1/1986 | Japan . |
| 61-231562 | 10/1986 | Japan . |
| 61-231563 | 10/1986 | Japan . |
| 63-118757 | 5/1988 | Japan . |
| 63-279263 | 11/1988 | Japan . |
| 63-279264 | 11/1988 | Japan . |
| 1-93748 | 4/1989 | Japan . |
| 1-204061 | 8/1989 | Japan . |
| 1254969 | 10/1989 | Japan . |
| 2-1870 | 1/1990 | Japan . |
| 2-89064 | 3/1990 | Japan . |
| 2-90175 | 3/1990 | Japan . |
| 2-167561 | 6/1990 | Japan . |

*Primary Examiner*—S. Rosasco
*Attorney, Agent, or Firm*—Oliff & Berridge

[57] ABSTRACT

A developer for developing an electrostatic latent image, said developer comprising (i) a toner containing at least a binder resin and a colorant, and (ii) substantially spherical silica fine particles having a bulk density of not less than 300 g/l; a process for producing the developer; and a process for forming a toner image using the developer. The developer exhibits satisfactory fluidity and satisfactory cleanability while retaining environmental stability and durability. The developer causes no toner filming on the surface of a photoreceptor, the surface of a carrier, or the surface of a charge-imparting member.

26 Claims, No Drawings

DRY TONER FOR DEVELOPING ELECTROSTATIC LATENT IMAGE, PROCESS FOR PRODUCING SAME, AND IMAGE FORMATION PROCESS USING SAME

FIELD OF THE INVENTION

This invention relates to a dry toner for development of an electrostatic latent image in electrophotography or electrostatic recording, a magnetic toner containing the same, a process for producing the dry toner, and a process for forming an image using the dry toner.

BACKGROUND OF THE INVENTION

Electrophotographic dry developers are divided into one-component developers comprising a toner itself containing a binder resin having dispersed therein a colorant and two-component developers comprising a toner and a carrier. In carrying out electrophotography using either type of the developer, an electrostatic latent image formed on a photoreceptor is visualized with the developer to form a toner image, which is then transferred to a transfer material, such as paper or a sheet, and fixed by means of heat, a solvent, pressure, etc. Thereafter, the photoreceptor is cleaned to remove any remaining toner.

Accordingly, a dry developer is required to satisfy various conditions in electrophotography, particularly in the development step or cleaning step. That is, a toner should be used not in the form of agglomerates but in the form of independent particles. To this effect, it is required that the toner should have sufficient fluidity and that the flow characteristics or electrical characteristics of the toner should not be changed with time or change in environmental conditions such as temperature and humidity. Further, the toner on the photoreceptor should be completely transferred to a transfer material, or if it remains thereon, the residual toner should be completely removed from the photoreceptor by a cleaning step.

In addition, the toner in a two-component developer is required to cause no filming phenomenon, i.e., caking of a toner, on the surface of carrier particles.

Development and transfer each consist in, in principle, relieving toner particles of the bonds with a substrate supporting them and adhering them to another substrate (i.e., a photoreceptor or a transfer material), while somewhat influenced by uniformity in the developer flow or the electric current at the time of transfer. Therefore, these steps greatly depend on the balance between static attraction and adhesion between toner particles and a charge-imparting member or adhesion between toner particles and a photoreceptor. While this balance is very difficult to control, there is a demand for high performance in these steps because these steps have direct influences on image quality and also because an improvement in efficiency of these steps is expected to bring about improved reliability and energy saving in cleaning.

The development or transfer takes place when static attraction force is greater than adhesive force. Therefore, improvement in efficiency in these steps may be achieved either by increasing the static attraction force (i.e., by enhancing a developing or transferring force) or by decreasing the adhesive force. An increase in developing or transferring force through, for example, an increase in electrical field for transfer, is apt to cause secondary troubles, such as occurrence of toner particles bearing opposite polarity. Accordingly, reduction of adhesive force is a more effective approach.

The adhesive force includes Van der Waals force (non-static adhesion force) and mirror image force of charges possessed by toner particles. The former being far greater than the latter nearly by one figure, it can consider the adhesive force in terms of Van der Waals force.

Van der Waals force F among spherical particles is represented by equation:

$$F=H\cdot r_1\cdot r_2/6(r_1+r_2)\cdot a^2$$

wherein H represents a constant; $r_1$ and $r_2$ each represent a radius of particles in contact with each other; and a represents a distance between the particles.

In order to reduce the adhesive force, it has been proposed to incorporate fine particles having a much smaller radius than toner particles between toner particles and the surface of a photoreceptor or a charge-imparting member thereby to separate them apart with a distance and to reduce the contact area (the number of contact points). In this connection, addition of various additives, such as inorganic compounds, e.g., silica, alumina and zinc oxide, to a toner has been suggested for improvements in development and transfer efficiency, fluidity, durability, or cleanability.

With respect to cleaning, the toner remaining on a photoreceptor should easily be removed therefrom. Where a cleaning element, such as a blade or a web, is used in the cleaning step, scratching of the photoreceptor with such an element should be avoided.

For the purpose of meeting these requirements, it has been proposed to add to a one-component or two-component developer various external additives for improving fluidity, durability or cleanability, such as inorganic powders (e.g., silica) and organic powders (e.g., fatty acids, fatty acid metal salts, and derivatives thereof, styrene-acrylic resins, olefin resins, and fluorine-containing resins).

Of the additives proposed to date, inorganic powders, such as silica, alumina, and zinc oxide, considerably improve fluidity of dry developers, as described in JP-A-59-226355, JP-A-61-23160, JP-A-63-118757, JP-A-2-1870, and JP-A-2-90175 (the term "JP-A" as used herein means an "unexamined published Japanese patent application"). However, because of their hardness and irregularity in shape, they are liable to separate from toner particles and cause scratches on the surface of a photoreceptor upon cleaning. It easily follows that toner particles cake onto the scratched part of the photoreceptor. Further, these fine powders tend to migrate to the surface of the photoreceptor and adhere thereto to form nuclei on which resins, etc. are accumulated in the meantime to cause troubles, such as formation of black spots on the photoreceptor.

Recently, size reduction of toner particles has been promoted for the purpose of improving image quality, reducing a pile-height of toner image in a digital imaging device, or reducing toner consumption. Size reduction of toner particles, however, leads to an increase in average number of contact points per unit weight, and in accordance therewith the Van der Waals force increases, which entertains a fear of considerable reductions in toner fluidity and development and transfer performance.

In order to overcome this problem, it has been studied to increase the amount of the inorganic compound to be added or to use a transfer-improving agent in combination, as disclosed in JP-A-63-279263 and JP-A-63-279264. However, such a solution arouses secondary problems due to release of the additive, such as charging disorder and filming on the photoreceptor.

It has also been proposed to apply a mechanical impact so as to firmly adhere an externally added additive, such as an inorganic compound, to the surface of toner particles and to prevent the additive from migrating to a photoreceptor, a cleaning element, etc., as disclosed, e.g., in JP-A-2-167561. This technique is effective to alleviate the troubles arising from release of the inorganic compound (e.g., formation of black spots on the photoreceptor) but, on the other hand, results in serious impairment of fluidity.

In recent years, a magnetic one-component development system has been regarded with expectation of high reliability, which will exclude the necessity of maintenance, and size reduction or simplification of an electrophotographic device. However, a magnetic one-component development system is liable to cause troubles characteristic of a magnetic powder, such as wear or damage of a photoreceptor with a released magnetic powder released from toner particles or exposed on the surface of the toner particles.

Recycled paper has been steadily extending its use with the aim of resources-saving. In general, recycled paper generates much paper dust, and the paper dust tends to enter the gap between a photoreceptor and a cleaning blade, causing cleaning defects, such as black streaks.

In order to overcome these problems, external addition of fatty acid metal salts (as described in JP-A-59-187347 and JP-A-60-198556) or waxes, e.g., polyethylene wax, (as described in JP-A-55-12977, JP-A-61-231562, and JP-A-61-231563) as a lubricant has been studied.

Any of these external additives proposed has a large particle size of from 3 to 20 μm. Accordingly, they should be added in a considerable amount to be made efficient use of. Besides, although these lubricants are effective in the initial stage, they themselves undergo a filming phenomenon, failing to form a uniform lubricating film, causing image defects, such as white spots and blurs.

A cleaning system using a rubber blade, a brush, etc. has been employed particularly where an organic photoreceptor in a belt form (hereinafter referred to as a "belt photoreceptor") is used in a high-speed copying machine. As compared with a drum photoreceptor, cleanability of an organic belt photoreceptor is largely affected by its distortion or sag. Therefore, cleaning of an organic belt photoreceptor must be carried out under a high load of a blade upon the photoreceptor. Further, the state-of-the-art belt photoreceptors have seams, at which a blade chatters or a blade is scratched to cause poor cleaning. Addition of the above-mentioned additives to the toner has been examined for applicability to such a belt photoreceptor system. It was revealed as a result that the particles added are easily deformed under strong shearing in every case. That is, the additives are effective in the initial stage but undergo a filming phenomenon itself before long to cause white spots, blurs, etc.

In an attempt to improve fixing so as to cope with an increased copying speed, use of a styrene-acrylic copolymer having two molecular weight peaks as a binder resin of a toner has been proposed, as disclosed in JP-A-1-204061. However, due to the presence of a low-molecular weight polymer component, the toner has low rheological characteristics and undergoes deformation due to shearing on cleaning. As a result, the toner tends to undergo a filming phenomenon on the photoreceptor or adhesion or fusion with a carrier (hereinafter referred to as "impaction"), leading to a reduction of working life of the developer.

It has been suggested to add hydrophobic hard fine particles to a toner so that a photoreceptor is abraded by the hard fine particles to prevent toner filming as disclosed in JP-A-2-89064. While effective to prevent a filming phenomenon, the hard particles added wear the surface of a photoreceptor, resulting in a serious reduction in durability of the photoreceptor. A cleaning blade is also worn out by the hard fine particles.

In addition, since the surface of inorganic oxide particles is generally covered with a hydroxyl group, they adsorb moisture under a high humidity condition when added as an external additive, exerting influences on the charge quantity or fluidity of the toner. That is, addition of inorganic oxide particles results in increase in dependence on environmental conditions.

With respect to magnetic powders, surface treatment with a titanium coupling agent, etc. for improving compatibility with a binder resin (as described in JP-A-56-51755, JP-A-60-121457, and JP-A-60-166959), application of mechanical force for adhering the magnetic powder to the surface of toner particles or for burying the magnetic powder in the toner particles thereby reducing exposed or free magnetic powders (as described in JP-A-64-93748), or use of a spherical magnetic powder for reducing the stress with a photoreceptor have been suggested.

In order to meet the recent demands for low potential, high development performance, and high image quality, several techniques for increasing mobility of a developer have been proposed. Among them is the use of a developer composed of a toner and a low-specific gravity, dispersion type carrier essentially comprising a resin and a magnetic powder. However, the low-specific gravity and low-magnetic force dispersion type carrier is apt to adhere to the surface of a photoreceptor and give scratches thereto on cleaning.

SUMMARY OF THE INVENTION

An object of the present invention is to provide a developer for developing an electrostatic latent image which satisfies fluidity, cleanability and suitability to high-speed fixing while retaining environmental stability and durability and which exhibits stable and excellent developing and transferring performance without causing toner filming on the surface of a photoreceptor, the surface of a carrier used in a two-component development system, or the surface of a charge-imparting member used in a one-component development system.

Another object of the present invention is to provide a developer for developing an electrostatic latent image which causes no reduction in working life of a photoreceptor or a cleaning blade.

A still another object of the present invention is to provide a developer for developing an electrostatic latent image, particularly for use in a two-component development system using a magnetic powder dispersion type carrier, which has satisfactory cleanability, causes no toner filming on the surface of a photoreceptor or the carrier, and can be cleaned from the surface of a photoreceptor without giving scratches thereto.

A further object of the present invention is to provide a developer for developing an electrostatic latent image which satisfies fluidity and cleanability while retaining environmental stability and durability, which causes no wear or damage to the surface of a photoreceptor, the surface of a carrier used in a two-component development system, or the surface of a charge-imparting member used in a one-component development system, and which causes no toner filming on the surface of a photoreceptor.

A still further object of the present invention is to provide a process for preparing the above-mentioned developer.

A yet further object of the present invention is to provide a process for forming a toner image with the above-mentioned developer.

As a result of extensive investigations, the inventors have found that use of fine and nearly spherical silica particles having a bulk density of not less than 300 g/l as an external additive achieves the above objects of the present invention, such as satisfactory cleanability and no adverse influence on chargeability of a toner.

The present invention relates to a developer for developing an electrostatic latent image, the developer comprising (i) a toner containing at least a binder resin and a colorant, and (ii) substantially spherical silica fine particles having a bulk density of not less than 300 g/l.

The present invention also relates to a process for producing a developer for developing an electrostatic latent image comprising the steps of: adding inorganic compound particles to a toner containing at least a binder resin and a colorant; and then, in a separate stage, adding substantially spherical silica fine particles having a bulk density of not less than 300 g/l to said toner.

The present invention further relates to a process for forming a toner image comprising the steps of:

forming an electrostatic latent image on a belt photoreceptor;

developing the latent image with a developer to form a toner image;

transferring the toner image to a transfer material; and cleaning the belt photoreceptor with a cleaning member to remove a residual toner, the developer comprising (i) a toner containing at least a binder resin and a colorant, and (ii) substantially spherical silica fine particles having a bulk density of not less than 300 g/l.

DETAILED DESCRIPTION OF THE INVENTION

The developer of the present invention is characterized by (i). the use of fine and substantially spherical silica particles having a bulk density of not less than 300 g/l as an external additive achieves the above objects of the present invention, such as satisfactory cleanability and no adverse influence on chargeability of a toner.

On close studies on the usage of the above-mentioned specific silica particles and the composition, and a developer containing such silica particles, the following embodiments have been revealed to bring about particular improvements.

(ii) Toner impaction can be prevented by using silica particles having the above-mentioned properties and also having a low coefficient of friction. A working life of a developer can be extended as a result.

(iii) Environmental dependence can be reduced and storage stability can be improved by using silica particles having the above-mentioned properties and also having been subjected to a treatment with a coupling agent or a treatment for rendering hydrophobic.

(iv) Toner impaction onto a carrier and toner filming on a photoreceptor can be prevented while retaining satisfactory fixing properties by using the above-mentioned specific silica particles in combination with a resin having two molecular weight peaks as a binder resin of a toner.

(v) High image quality can be achieved by using small diameter toner particles in combination with the above-mentioned specific silica particles while minimizing the impairment of developing and transferring performance, which has conventionally accompanied the use of the small diameter toner particles. This leads to a reduction in toner consumption.

(vi) When the above-described specific silica particles are used in combination with a magnetic powder as a component of a magnetic powder dispersion type carrier or as a toner component, damage to a photoreceptor which has been caused by released magnetic particles can be reduced. Low-potential high-development performance, and high reliability can thus be achieved.

From the standpoint of durability and environmental stability, the nearly spherical silica fine particles to be used in the present invention preferably have a coefficient of friction of not more than 0.6 (embodiment (ii)) or are preferably subjected to a treatment with a coupling agent or an agent for rendering hydrophobic (embodiment (iii). From the standpoint of fixing properties, the binder resin of the toner is preferably a styrene-acrylic resin having two molecular weight peaks, one in the range of from 1000 to 50,000 and the other from 100,000 to 1,000,000 (embodiment (iv)). From the standpoint of high image quality, the toner of the developer preferably has a volume-average particle size of from 4 to 10 μm (embodiment (v)). Magnetic particles comprising a resin having dispersed therein particles of a magnetic substance can be used as a carrier of a two-component developer or a magnetic toner (embodiment (vi)).

On further studies on the usage or preparation of a developer containing the silica particles, the following embodiments have also been revealed to bring about particular improvements.

(vii) When a developer is prepared by adding an inorganic compound external additive and the above-described specific silica particles in the respective stage of addition, i.e., in two divided stages, in this order, the resulting developer has an extended working life.

(viii) In an electrophotographic system in which development, transfer, fixing, and cleaning are conducted at a high speed, the use of a toner having adhered thereon the above-mentioned specific silica particles makes it possible to carry out cleaning of a belt photoreceptor having seams without any problem. High-speed copying with high reliability can thus be achieved.

The developer according to the present invention comprises toner particles essentially containing a binder resin and a colorant, having adhered on the surface thereof substantially spherical silica fine particles (hereinafter simply referred to as "spherical fine silica particles") having a bulk density of not less than 300 g/l. The spherical fine silica particles can be obtained by a deflagration method, in which silicon and oxygen undergo a rapid combustion reaction at a rate of several hundreds of meters per second. Fine silica particles obtained by a deflagration method generally have a high density of 2.1 mg/mm$^3$ or more and assumes a true spherical shape with a smooth surface. For reference, colloidal silica obtained by a usual hydrolysis method has a bulk density of from 50 to 200 g/l.

Spherical fine silica particles having a bulk density of less than 300 g/l, though making a contribution to improvement in fluidity, have scattering character and increased adhesiveness and thus show only a reduced function as an interaction depressant.

The spherical fine silica particles to be used generally have an average primary particle size (hereinafter simply referred to as an "average particle size") of from 0.05 to 3.0 μm, and preferably from 0.1 to 1.0 μm. If the average particle size is less than 0.05 μm, the particles may be buried in the recesses on the toner surface to lessen the function as a roller, i.e., as an interaction depressant. If it exceeds 3.0 μm, the silica particles tend to act as a spacer between a blade and a photoreceptor to let toner particles to be wiped off escape therethrough. In particular, a sufficient effect of reducing the contact area of toner particles cannot be obtained particularly under a stress.

Deterioration of a carrier is considered as a cause of reduction of a developer life. That is, an impaction phenomenon in that part of the toner or a toner component is adhered or fused to the carrier occurs in parts of a developing device where strong shear is locally imposed, such as a trimming blade, a stirring part, a scavenging part, etc. The toner impaction results in serious reduction of charging ability of the carrier.

Where spherical fine silica particles serving as a roller have a coefficient of friction of not more than 0.60, such strong local shear is relaxed to suppress the toner impaction to the carrier thereby extending the working life of the developer. Further, such spherical fine silica particles reduce the frictional force between a cleaning member and a photoreceptor to improve cleaning properties.

A coefficient of friction as referred to in the present invention can be determined as follows: A rubber blade is placed on an aluminum plate coated with a photosensitive layer under a constant load, and the aluminum plate is reciprocated with a small amount of a cleaning-improving agent, such as spherical fine silica particles, being spread thin thereon. A frictional force F between the blade and the aluminum plate is measured with a monitoring apparatus. A coefficient of friction μ of the cleaning-improving agent can be obtained from the measured value and a contact force W (the constant load of the blade on the aluminum plate) according to equation:

$$\mu = F/W$$

In the present invention, the coefficient of friction is preferably not more than 0.60 at the point when the aluminum plate has been reciprocated 50 times (hereinafter referred to as a "coefficient of friction at 50 strokes"). If the difference between a coefficient of friction at the point when the aluminum plate has been reciprocated 5 times (hereinafter referred to as a "coefficient of friction at 5 strokes") and that at 50 strokes is small , the difference between a coefficient of static friction and a coefficient of dynamic friction is small. This means excellent cleaning properties. That is, the cleaning-improving agent does not cause filming which may increase a coefficient of friction. Accordingly, it is more preferable that the spherical fine silica particles used in the present invention have a coefficient of friction of not more than 0.60 at 50 strokes and of not more than 0.70 at 5 strokes.

The spherical fine silica particles may be subjected to a surface treatment with a coupling agent, such as a titanium coupling agent and a silane coupling agent, or an agent for rendering hydrophobic.

Examples of titanium coupling agents which can be used in the present invention include those capable of reacting with a hydroxyl group present on the surface of the fine silica particles. Specific examples of the titanium coupling agents are shown in Table 1 below.

TABLE 1

| Compound Name | Titanium Coupling Agent<br>Structural Formula |
|---|---|
| Isopropyltriisostearoyl titanate | 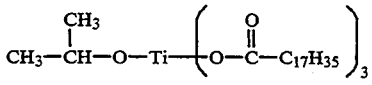 |
| Isopropyltridodecyl-benzenesulfonyl titanate | 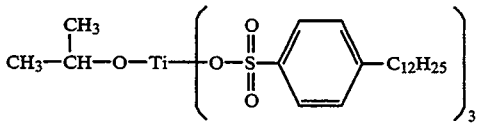 |
| Isopropoxytitanium tri(dioctyl pyrophosphate) | 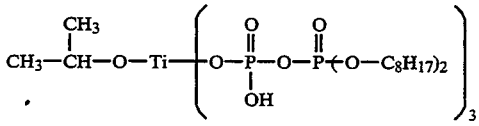 |
| Tetraisopropyl titanate bis(dioctyl phosphite) | 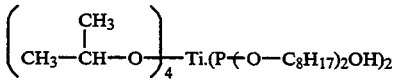 |
| Tetraoctyl titanate bis-(di-tridecyl phosphite) | $(C_8H_{17}-O)_4Ti.(P(O-C_{13}H_{27})_2OH)_2$ |

TABLE 1-continued

| Compound Name | Titanium Coupling Agent<br>Structural Formula |
|---|---|
| Tetra[2,2-di-(allyloxy-methyl)butyl]titanate bis(di-tridecyl phosphite) | $\left(C_2H_5-C(-CH_2-O-CH_2-CH=CH_2)_2-CH_2-O-\right)_4 Ti.(P(-O-C_{13}H_{27})_2OH)_2$ |
| Ethylenedioxytitanium bis(dioctyl pyrophosphate) | 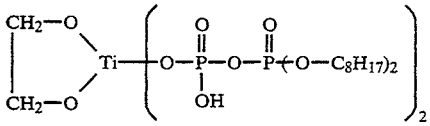 |
| Isopropyltrioctanoyl titanate | 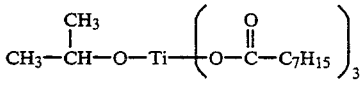 |
| Isopropylisostearoyl-dimethacryl titanate | 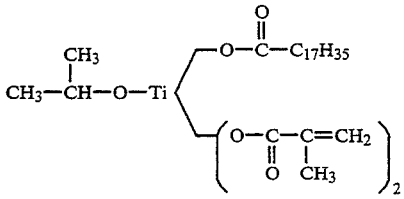 |
| Isopropylisostearoyl-diacryl titanate | 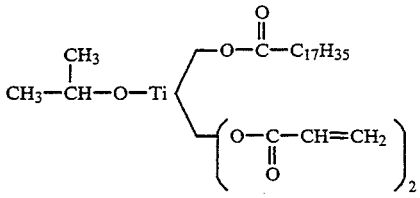 |
| Isopropoxytitanium tri(dioctyl phosphate) | 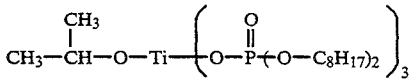 |
| Isopropyltri[p-(2-phenyl-2-propyl)phenyl] titanate | 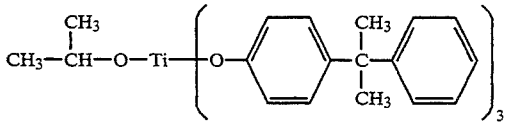 |
| Isopropyltri(N-aminoethyl-aminoethyl) titanate | $CH_3-CH(CH_3)-O-Ti(-O-C_2H_4-NH-C_2H_4-NH_2)_3$ |
| Bis[p-(2-phenyl-2-propyl)-phenyl]oxoethylene titanate | 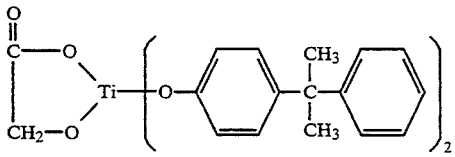 |
| Diisostearoylethylene titanate | 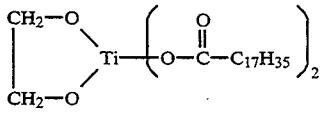 |
| Oxoethylenedioxytitanium bis(dioctyl pyrophosphate) | 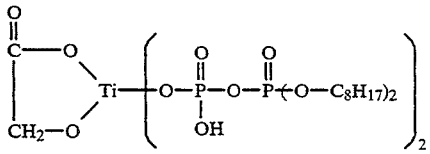 |

Examples of silane coupling agents which can be used in the present invention include those capable of reacting the hydroxyl group present on the surface of the silica fine particles. Specific examples of suitable silane coupling agents include alkylakoxysilanes, e.g., methyltrimethoxysilane, methyltriethoxysilane, ethyltriethoxysilane, hexyltrimethoxysilane, and octyltrimethoxysilane; amino-containing alkoxysilanes, e.g., γ-aminopropyltrimethoxysilane, γ-aminopropyltriethoxysilane, and N-(β-aminoethyl)-γ-aminopropyltrimethoxysilane; vinyl-containing alkoxysilanes, e.g., vinyltrimethoxysilane, vinyltriethoxysilane, vinyltripropoxysilane, and vinyltris(2-methoxymethoxy)silane; mercapto-containing alkoxysilanes, e.g., γ-mercaptopropyltrimethoxysilane and γ-mercaptopropyltriethoxysilane; and methacryloxy-containing alkoxysilanes, e.g., γ-methacryloxypropyltrimethoxysilane. The above-enumerated compounds with their alkoxy group substituted with a chlorine atom are also usable.

Examples of agents for rendering silica particles hydrophobic which can be used in the present invention include the above-mentioned silane coupling agents (such as chlorosilanes, e.g., dimethyldichlorosilane and trimethylchlorosilane, and alkoxysilanes, e.g., trimethylmethoxysilane and triethylehtoxysilane), disilazanes (e.g., hexamethyldisilazane), trimethylsilylmercaptan, vinyldimethylacetoxysilane, trimethylsilyl acrylate, hexamethyldisiloxane, silicone oil, the above-mentioned titanium coupling agents, aluminum coupling agents, and zirconium coupling agents.

These coupling agents or agents for rendering hydrophobic may be used either individually or in combination of two or more thereof.

The coupling agent or agent for rendering hydrophobic is preferably used in an amount of from 0.01 to 20% by weight based on the weight of the spherical fine silica particles.

The treatment of the spherical fine silica particles with the coupling agent may be carried out by various processes known in the art, such as a wet process in which spherical fine silica particles are mixed with a solution of a coupling agent in an appropriate solvent followed by removal of the solvent, a dry process in which spherical fine silica particles are dry blended with a coupling agent in a mixing machine, or a vapor phase process in which spherical fine silica particles as produced by a deflagration method are brought into contact with a silane coupling agent together with an inert gas and, in some cases depending on the kind of the coupling agent, steam in a high temperature.

The spherical fine silica particles, either untreated or treated with the above-mentioned coupling agent or agent for rendering hydrophobic, may further be treated with the above-mentioned agent for rendering hydrophobic. The treatment with the coupling agent and the treatment with the agent for rendering hydrophobic may be effected simultaneously.

The toner in the developer of the present invention mainly comprises a binder resin and a colorant.

Examples of the binder resins include homo- or copolymers of styrene or derivatives thereof, e.g., α-methylstyrene, chlorostyrene, and vinylstyrene; mono-olefins, e.g., ethylene, propylene, butylene, and isobutylene; diolefins, e.g., butadiene and isoprene; vinyl esters, e.g., vinyl acetate, vinyl propionate, vinyl butyrate, and vinyl benzoate; α-methylene aliphatic monocarboxylic acid esters, e.g., methyl acrylate, ethyl acrylate, butyl acrylate, octyl acrylate, dodecyl acrylate, phenyl acrylate, methyl methacrylate, ethyl methacrylate, butyl methacrylate, and dodecyl methacrylate; vinyl ethers, e.g., vinyl methyl ether, vinyl ethyl ether, and vinyl butyl ether; and vinyl ketones, e.g., vinyl methyl ketone, vinyl hexyl ketone, and vinyl isopropenyl ketone.

Among them particularly typical binder resins include polystyrene, polyethylene, polypropylene, styrene-butadiene copolymers, styrene-alkyl acrylate copolymers, styrene-alkyl methacrylate copolymers, styrene-acrylonitrile copolymers, and styrene-maleic anhydride copolymers. In addition, polyester resin, polyurethane resins, epoxy resins, silicone resins, polyamide resins, modified rosin, paraffins, and waxes are also employable.

Of the above-mentioned binder resins, preferred include styrene-acrylic resins, e.g., a styrene-alkyl acrylate copolymer and a styrene-alkyl methacrylate copolymer, that have two molecular weight peaks in their molecular weight distribution curve, one of which is in the range of from 1000 to 50,000 and the other is in the range of from 200,000 to 1,000,000. That is, the resin is composed of a high molecular weight component and a low molecular weight component. The high molecular weight component preferably has a weight average molecular weight Mw of from $1\times10^5$ to $5\times10^6$ and a number average molecular weight Mn of from $1\times10^5$ to $5\times10^5$, and the low molecular weight component preferably has a weight average molecular weight Mw of from $1\times10^3$ to $5\times10^4$ and a number average molecuar weight Mn of from $1\times10^3$ to $1\times10^4$, as measured by gel-permeation chromatography under the following conditions:

Apparatus: "HLC-802A" manufactured by Toso Co., Ltd.
Columns: two columns of "GMH 6"
Standard: 10 kinds of TSK standard polystyrene
Solvent: tetrahydrofuran Examples of colorants used in the toner include magnetic powders and dyes or pigments, such as carbon black, nigrosine dyes, Aniline Blue, Chalcoyl Blue, Chrome Yellow, Ultramarine Blue, Dupon Oil Red, Quinoline Yellow, Methylene Blue chloride, Phthalocyanine Blue, Malachite Green oxalate, Lamp Black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

The toner may be a magnetic toner comprising a binder resin having dispersed therein a magnetic fine powder. Any kind of commonly employed ferromagnetic substances may be used as a magnetic powder. Examples of the magnetic powders include magnetic metals, e.g., iron, cobalt, and nickel; alloys of these metals; metal oxides, e.g., Co-doped iron oxide and chromium oxide; various ferrite species, e.g., Mn-Zn ferrite and Ni-Zn ferrite, magnetite; and hematite. These magnetic powders may be treated with a surface treating agent, such as a silane coupling agent, an aluminum coupling agent, or a titanium coupling agent; or may be coated with a polymer.

The magnetic powder preferably has a particle size of from 0.05 to 1.0 μm.

The toner for developing an electrostatic latent image preferably has a volume-average particle size ($D_{50}$) of not more than 20 μm, and more preferably from 4 to 8 μm. Toner particles having a volume-average particle size of less than 4 μm are difficult to produce by a conventional kneading/grinding process and the production yield becomes low. If the volume-average particle size of the toner exceeds 10 μm, the above-described merits of the small-diameter toner (e.g., fine line reproducibility and reduced toner consumption) cannot be obtained.

If desired, the toner of the present invention may further be compounded with inorganic compounds other than the spherical fine silica particles, such as fluidity-improving agents (e.g., colloidal silica fine particles), charge control agents, parting agents, cleaning aids, and waxes.

The inorganic compound which can be used in the present invention includes $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, and $MgSO_4$, with $SiO_2$, $TiO_2$, and $Al_2O_3$ being preferred. These inorganic compound may be rendered hydrophobic with hexamethyldisilazane, dimethyldichlorosilane, octyltrimethoxysilane, etc. The inorganic compound preferably has a particle size of not more than 0.1 μm.

The toner is not restricted by its constitution. For example, the toner may be a magnetic one-component toner containing a magnetic material or a capsule toner, or it may be for a one-component developer or for a two-component developer.

In the case where the toner is for a two-component developer, the carrier to be used in combination is not particularly limited. Examples of the carriers include iron powder, glass beads, ferrite powder, and nickel powder, each of which may have a resin coating. A carrier comprising a resin having dispersed therein magnetic fine particles (hereinafter referred to as a "magnetic powder-dispersion type carrier") may also be used for achieving low-potential and high-development.

Examples of magnetic fine particles used in the magnetic powder-dispersion type carrier include magnetic metals, e.g., iron, cobalt, and nickel; alloys of these metals; metal oxides, e.g., Co-doped iron oxide and chromium oxide; various ferrite species, e.g., Mn-Zn ferrite and Ni-Zn ferrite; magnetite; and hematite. The magnetic particles preferably have a particle size of from 0.05 to 1.0 μm. The content of the magnetic fine particles in the carrier generally ranges from 30 to 95% by weight based on the total carrier components.

The magnetic powder-dispersion type carrier may further contain fine particles of resins, charge control agents, coupling agents, fillers, etc. for the purpose of charge control, improvement of dispersion, strength enhancement, improvement of fluidity, and the like.

The magnetic powder-dispersion type carrier can be prepared, for example, by kneading and grinding a resin, a magnetic powder and, if desired, a charge control agent, followed by classification, or by liquefying these components with a solvent or by heating, followed by spray drying.

In the case where the toner is used as a one-component developer, the developer can be prepared simply by blending toner particles with the treated or untreated spherical fine silica particles. The amount of the spherical fine silica particles to be mixed preferably ranges from 0.1 to 10% by weight.

In the case where the toner is for a two-component developer, the spherical fine silica particles may previously added to the surface of the toner particles, and then the toner particles having added thereto the silica particles are blended with a carrier. In this case, the amount of the silica particles to be added preferably ranges from 0.1 to 10% by weight. Alternatively, the silica particles may be added to the carrier or may be added to the system at the time of preparing a developer. In this case, the amount of the silica particles to be added preferably ranges from 0.03 to 1.0% by weight.

The two-component developer of the present invention may be prepared by uniformly dispersing the treated or untreated spherical fine silica particles with toner particles in a mixing machine, such as a twin-cylinder mixer or a Henschel mixer, and then mixing the blend with a carrier and, if desired, the above-mentioned various additives. If adhesion of fine silica particles to toner particles causes a sudden rise of the coefficient of friction of the toner particles, the characteristics of the spherical fine silica particles cannot be fully displayed. Such a mode of mixing is unfavorable.

The adhesion of the spherical fine silica particles to the surface of the toner particles may be mere physical adhesion or loose caking on the surface. Further, the silica particles may cover the entire surface or a part of the surface of the toner particles. The surface-treated silica fine particles on the toner particles may be partly agglomerated but preferably form a mono-particulate layer.

If fine particles of an inorganic compound are added after addition of the spherical fine silica particles, there is a possibility that the inorganic compound is externally added to not only the toner particles but also the surface of the spherical fine silica particles due to a difference in adhesive strength (i.e., a difference in shearing stress imposed from the outside). Such being the case, the effects of the silica particles owing to their true spherical shape with a very smooth surface may not be fully displayed. Therefore, it is preferable to prepare the developer of the present invention by adding an inorganic compound with moderate adhesive force by means of a Henschel mixer, etc. in a first stage of addition and then adding the spherical fine silica particles with weak shear by means of a twin-cylinder mixer, etc. in a second stage of addition.

Usage of the developer according to the present invention can be appropriately adjusted according to a dry process applied. In general, the developer is applicable to an electrophotographic or electrostatic recording process consisting of formation of an electrostatic latent image on a latent image-supporting substrate, visualization (development) of the latent image with a developer, transfer of the developed image (toner image) to another substrate, and cleaning of the latent image-supporting substrate to remove any remaining toner. For example, an electrostatic latent image is electrophotographically formed on a photoreceptor, or an electrostatic latent image is electrophotographically formed on an electrostatic recording medium having a dielectric (e.g., polyethylene terephthalate) by means of pin electrodes. The latent image is developed by magnetic brush development, cascade development, touchdown development, etc. to form a toner image, which is then transferred to a transfer material, such as paper, and fixed. The residual toner on the photoreceptor or recording medium is cleaned.

The latent image-supporting substrate includes inorganic photoreceptors made of selenium, zinc oxide, cadmium sulfide, amorphous silicon, etc.; and organic photoreceptors comprising phthalocyanine pigments, bisazo pigments, etc.; amorphous silicon photoreceptors; and these photoreceptors having provided thereon an overcoat. Any of known developing machines, either for a two-component development system or for a one-component development system, may be employed.

Cleaning may be carried out by means of a blade, a web fur brush, a roll and the like, or appropriate combination thereof, for example, combination of blade cleaning and brush cleaning. The dry developer according to the present invention is particularly effective in cleaning an organic belt photoreceptor with a blade.

According to the present invention, since the spherical fine silica particles are hard and are hardly deformed, they themselves do not undergo filming on a photoreceptor and they form moderate gaps between toner particles and other members (e.g., toner particles, a photoreceptor, a charge-imparting member, etc.). The silica fine particles uniformly contact toner particles, a photoreceptor, and a charge-imparting member with a very small contact area because of their high sphericity and therefore exert a significant effect to reduce adhesive force, leading to improvements in development and transfer efficiency. Since the silica fine particles serve as a roller, they function as an interaction depressant between a cleaning blade and a photoreceptor without causing wear or damage to the photoreceptor. Even where cleaning is effected under a high stress (e.g., under a high load or at a high speed), they are hardly buried in toner particles. If slightly buried therein, they are ready to be released and restored. The developer thus exhibits stable characteristics for a prolonged period of time.

These characteristics produce an action of alleviating the shear imposed on toner particles. This action is effective to suppress the tendency of toner filming where a toner contains a polymer component of low rheological characteristics for achieving high-speed fixing (low energy fixing).

The above-mentioned effects of spherical fine silica particles are particularly conspicuous with those particles prepared by a deflagration method because they assume a substantially true spherical shape with a very smooth surface.

The developer of the present invention has little influence on charging, it is applicable to both of positively working and negatively working photoreceptors.

The excellent cleaning properties of the developer can be fully exerted when in using spherical fine silica particles having an average particle size of from 0.05 to 3.0 μm. Such small particles do not adversely affect powder fluidity of a toner.

For some unconfirmed reasons, the surface-treated spherical fine silica particles of the present invention have no substantial influence on charging characteristics of a toner. Accordingly, they can be used for both of positively working and negatively working developers. Should they contaminate a carrier, the degree of deterioration of the developer appears to be very low.

The present invention is now illustrated in greater detail with reference to Examples and Comparative Examples, but it should be understood that the present invention is not deemed to be limited thereto. All the percents, parts, and ratios are by weight unless otherwise indicated.

Measurement of Sphericity of Silica Particles:

The sphericity of the spherical fine silica particles used in Examples was measured as follows.

(1) Observation of Scanning Electron Micrograph:

In the present invention, spherical fine silica particles preferably have a minor axis/major axis ratio of their projected figure of 0.8 or more, and more preferably 0.9 or more. Every spherical fine silica particles used in Examples was found to have a minor axis/major axis ratio of 0.9 or more, indicating satisfactory sphericity.

(21) Wadell's Degree of Sphericity:

The Wadell's degree of sphericity Ψ was obtained by the following equation:

$$\psi = \frac{\text{Surface area of sphere having the same volume as silica particles}}{\text{Surface area of silica particles}}$$

The surface area of sphere having the same volume as the silica particles was calculated from an average particle size of the silica particles. As the surface area of the silica particles, a BET specific surface area measured with a powder specific surface area meter "SS-100" produced by Shimazu Corporation was used.

In the present invention, spherical fine silica particles preferably have a degree of sphericity Ψ of 0.6 or more, and more preferably 0.8 or more. Every spherical fine silica particles used in Examples was found to have a degree of sphericity Ψ of 0.80 or more.

Measurement of Bulk Density of Silica Particles:

The bulk density of the spherical fine silica particles and colloidal silica particles used in Examples and Comparative Examples was measured as follows:

Silica particles were slowly put into a 100 ml-measuring cylinder to a scale of 100 ml while giving no vibration to the cylinder, and the weight of the silica particles of this volume was measured. The bulk density was calculated from equation:

Bulk density (g/l) = Weight of silica (g/100 ml) × 10

| | |
|---|---|
| Styrene-butyl methacrylate copolymer (copolymerization ratio: 80/20) | 100 parts |
| Carbon black ("R-330" produced by Cabbot Corp.) | 10 parts |
| Low-molecular polypropylene ("Viscol 660P" produced by Sanyo Kasei Co., Ltd.) | 5 parts |
| Nigrosine ("Bontron N-04" produced by Orient Kagaku Co., Ltd.) | 1 part |

The above components were melt-kneaded in a Banbury mixer and, after cooling, finely ground in a jet mill, followed by classification to obtain a toner having an average particle size of 11 μm.

A hundred parts of the toner was mixed with 1 part of titanium dioxide fine particles having an average particle size of 0.05 μm and 0.5 part of spherical fine silica particles having an average particle size of 0.7 μm which were prepared by a deflagration method (bulk density: about 570 g/l) ("KMP-105" produced by Shin-Etsu Chemical Co., Ltd.) in a Henschel mixer to prepare a toner compounded with additives.

Separately, 90 parts of copper-zinc ferrite core particles having an average particle size of 80 μm were coated with 10 parts of a methylphenylsilicone polymer by means of a kneader coater to obtain a carrier.

Five parts of the toner and 95 parts of the carrier were mixed to obtain a developer.

EXAMPLE 2

A developer was obtained in the same manner as in Example 1, except for replacing the spherical fine silica particles having an average particle size of 0.7 μm with those having an average particle size of 0.1 μm (bulk density: about 400 g/l).

EXAMPLE 3

A developer was obtained in the same manner as in Example 1, except for replacing the spherical fine silica particles having an average particle size of 0.7 μm with those having an average particle size of 0.05 μm (bulk density: about 350 g/l).

EXAMPLE 4

A developer was obtained in the same manner as in Example 1, except for replacing the spherical fine silica particles having an average particle size of 0.7 μm with those having an average particle size of 3.0 μm (bulk density: about 520 g/l).

EXAMPLE 5

A developer was obtained in the same manner as in Example 1, except for replacing the nigrosine with an azochromium complex ("Spiron Black TRH" produced by Hodogaya Chemical Co., Ltd.) and replacing the titanium dioxide with 0.8 part of hydrophobic colloidal silica fine particles having an average particle size of 0.012 μm ("RX 200" produced by Nippon Aerosil Co., Ltd.).

EXAMPLE 6

A developer was obtained in the same manner as in Example 5, except for replacing the spherical fine silica particles having an average particle size of 0.7 μm with those having an average particle size of 2.0 μm (bulk density: about 500 g/l).

COMPARATIVE EXAMPLE 1

A developer was obtained in the same manner as in Example 1, except for using no spherical fine silica particles.

COMPARATIVE EXAMPLE 2

A developer was obtained in the same manner as in Example 1, except for replacing the spherical fine silica particles with low-molecular polyethylene particles having an average particle size of about 9 μm prepared by freeze-grinding low-molecular polyethylene ("200P" produced by Mitsui Petrochemical Industries, Ltd.), followed by classification.

COMPARATIVE EXAMPLE 3

A developer was obtained in the same manner as in Example 1, except for replacing the spherical fine silica particles with zinc stearate fine particles having an average particle size of 5.0 μm.

COMPARATIVE EXAMPLE 4

A developer was obtained in the same manner as in Example 1, except for replacing the spherical fine silica particles with hard fine particles obtained by surface-treating silicon carbide particles having an average particle size of 0.5 μm with a titanium coupling agent.

COMPARATIVE EXAMPLE 5

A developer was obtained in the same manner as in Example 5, except for using no spherical fine silica particles.

COMPARATIVE EXAMPLE 6

A developer was obtained in the same manner as in Example 5, except for replacing the spherical fine silica particles with the same low-molecular polyethylene fine particles as used in Comparative Example 2.

COMPARATIVE EXAMPLE 7

A developer was obtained in the same manner as in Example 5, except for replacing the spherical fine silica particles with zinc stearate fine particles having an average particle size of about 5.0 μm.

Each of the developers obtained in the foregoing Examples and Comparative Examples was tested in accordance with the following test methods by using a remodelled copying machine of "VIVACE 400" manufactured by Fuji Xerox Co., Ltd. for Examples 1 to 4 and Comparative Examples 1 to 4, and a remodelled copying machine of "FX-5039" manufactured by Fuji Xerox Co., Ltd. for Examples 5 and 6 and Comparative Examples 5 to 7. The results obtained are shown in Table 2 below.

1) Charging properties

The quantity of charge was measured with a blow-off meter ("TB 200" manufactured by Toshiba).

2) Cleaning Properties

A 5 cm wide black band was formed on the photoreceptor as a toner image, and, without being transferred, the toner image was wiped off with a cleaning blade. The cleaning test of 999 cycles was repeated 3 times. Developer samples rated "G1" to "G3" are acceptable in ordinary copying processing. Developer samples rated "G4" or "G5" cause poor cleaning in ordinary copying processing.

G1 . . . The toner on the photoreceptor was completely cleaned without any problem.

G2 . . . Poor cleaning was slightly observed from the 2500th cycle.

G3 . . . Poor cleaning occurred from the 1500th to 2499th cycle.

G4 . . . Poor cleaning occurred from the 500th to 1499th cycle.

G5 . . . Poor cleaning occurred on and before the 499th cycle.

3) Image Quality

After obtaining 100,000 copies, the image quality of the copies and the surface condition of the photoreceptor were observed.

*1 . . . During and after obtaining 100,000 copies, neither image defects, such as black spots, black streaks, and fog, nor scratches on the photoreceptor was observed.

*2 . . . Black streaks due to poor cleaning and black spots due to scratches on the photoreceptor developed from about the 800th copy.

*3 . . . Black steaks due to filming occurred from about the 1000th copy.

*4 . . . Black streaks due to filming occurred from about the 800th copy.

*5 . . . Black streaks due to poor cleaning and black spots due to scratches on the photoreceptor developed from about the 500th copy.

4) Wear of Photoreceptor:

After obtaining 100,000 copies, the wear (μm) of the photoreceptor was measured.

TABLE 2

| Example No. | Additive 1 (part) | Additive 2 (Size) (part) | Charge Quantity Initial Stage (μC/g) | Charge Quantity After Obtaining 100,000 Copies (μC/g) | Cleaning Properties | Image Quality | Wear of Photo-receptor (μm) |
|---|---|---|---|---|---|---|---|
| Example 1* | titanium dioxide (1.0) | spherical fine silica (0.7 μm) (0.5) | 19 | 17 | G1 | *1 | <1.0 |
| Example 2* | titanium dioxide (1.0) | spherical fine silica (0.1 μm) (0.5) | 20 | 16 | G1 | *1 | <1.0 |
| Example 3* | titanium dioxide (1.0) | spherical fine silica (0.05 μm) (0.5) | 20 | 15 | G2 | *1 | 4.0 |
| Example 4* | titanium dioxide (1.0) | spherical fine silica (3.0 μm) (0.5) | 21 | 18 | G2 | *1 | 1.0 |
| Comparative Example 1* | titanium dioxide (1.0) | — | 21 | 20 | G5 | *2 | 40 |
| Comparative Example 2* | titanium dioxide (1.0) | low-mol. poly-ethylene (9.0 μm) (0.5) | 23 | 18 | G4 | *3 | 10 |
| Comparative Example 3* | titanium dioxide (1.0) | zinc stearate (5.0 μm) (0.5) | 25 | 21 | G3 | *4 | 10 |
| Comparative Example 4* | titanium dioxide (1.0) | Ti coupling agent-treated silicon carbide (0.5 μm) (0.5) | 18 | 14 | G4 | *5 | 60 |
| Example 5** | hydrophobic silica (0.8) | spherical fine silica (0.7 μm) (0.5) | −22 | −20 | G1 | *1 | <1.0 |
| Example 6** | hydrophobic silica (0.8) | spherical fine silica (2.0 μm) (0.5) | −21 | −18 | G1 | *1 | <1.0 |
| Comparative Example 5** | hydrophobic silica (0.8) | — | −19 | −13 | G5 | *5 | 50 |
| Comparative Example 6** | hydrophobic silica (0.8) | low-mol. poly-ethylene (9.0 μm) (0.5) | −13 | −8 | G4 | *3 | 10 |
| Comparative Example 7** | hydrophobic silica (0.8) | zinc stearate (5.0 μm) (0.5) | −19 | −5 | G3 | *4 | 10 |

Note:
*: Tested with "VIVACE 400"
**: Tested with "FX-5039"

It is seen from the results in Table 2 that the spherical fine silica particles-containing developer according to the present invention is superior to the conventional developers in each of the tested items.

| | |
|---|---|
| Styrene-butyl acrylate copolymer (copolymerization ratio: 80/20) | 100 parts |
| Carbon black ("R-330") | 10 parts |
| Low-molecular polypropylene ("Viscol 660P") | 5 parts |
| Charge control agent ("Bontron N-04") | 1 part |

The above components were melt-kneaded in a Banbury mixer and, after cooling, finely ground in a jet mill. The grounds were classified in a classifier to obtain a toner having an average particle size of 11 μm. The toner had a coefficient of friction of 0.99.

A hundred parts of the toner were mixed with 1 part of fine titanium dioxide particles having an average particle size of 0.05 μm, and 0.5 part of spherical fine silica particles having an average particle size of 0.7 μm, a coefficient of friction of 0.40 at 50 strokes, and a coefficient of friction of 0.50 at 5 strokes (bulk density: about 500 g/l) in a Henschel mixer to prepare a toner compounded with additives. The resulting toner had a coefficient of friction of 0.65.

Separately, spherical ferrite core particles having an average particle size of 50 μm were coated with a styrene-butyl methacrylate copolymer (copolymerization ratio: 80/20) by means of a kneader coater to obtain a carrier.

The toner and the carrier were mixed at a weight ratio of 5/95 to obtain a two-component developer.

EXAMPLE 8

A hundred parts of the same toner as prepared in Example 7 (before compounding of additives), 0.5 part of hydrophobic colloidal silica having an average particle size of 0.007 μm ("R 812" produced by Degsa Co., Ltd.), and 0.5 part of spherical fine silica particles having an average particle size of 0.7 μm and a coefficient of friction of 0.60 at 50 strokes and 0.70 at 5 strokes (bulk density: about 500 g/l) were mixed in a Henschel mixer to prepare a toner. The resulting toner compounded with additives had a coefficient of friction of 0.78.

The toner was mixed with the same carrier as used in Example 7 at a weight ratio of 5/95 to obtain a two-component developer.

EXAMPLE 9

A hundred parts of the same toner as prepared in Example 7 (before compounding of additives), 0.5 part of hydrophobic colloidal silica having an average particle size of 0.007 μm ("R 812") and 0.5 part of spherical fine silica particles having an average particle size of 0.05 μm and a coefficient of friction of 0.42 at 50 strokes and 0.48 at 5 strokes (bulk density: about 380 g/l) were mixed in a Henschel mixer to prepare a toner. The resulting toner compounded with additives had a coefficient of friction of 0.82.

The toner was mixed with the same carrier as used in Example 7 at a weight ratio of 5/95 to obtain a two-component developer.

EXAMPLE 10

A hundred parts of the same toner as prepared in Example 7 (before compounding of additives), 0.5 part of hydrophobic colloidal silica having an average particle size of 0.007 μm ("R 812") and 0.5 part of spherical fine silica particles having an average particle size of 3.0 μm and a coefficient of friction of 0.60 at 50 strokes and 0.75 at 5 strokes (bulk density: about 550 g/l) were mixed in a Henschel mixer to prepare a toner. The resulting toner compounded with additives had a coefficient of friction of 0.82.

The toner was mixed with the same carrier as used in Example 7 at a weight ratio of 5/95 to obtain a two-component developer.

COMPARATIVE EXAMPLE 8

A two-component developer was obtained in the same manner as in Example 7, except for replacing the spherical fine silica particles with titanium dioxide having an average particle size of 0.05 μm and a coefficient of friction of 0.95 at 50 strokes and 0.95 at 5 strokes. The toner compounded with the additives had a coefficient of friction of 0.98.

COMPARATIVE EXAMPLE 9

A two-component developer was obtained in the same manner as in Example 8, except for using no spherical fine silica particles and using hydrophobic colloidal silica having an average particle size of 0.007 μm and a coefficient of friction of 0.85 at 50 strokes and 0.92 at 5 strokes (bulk density: about 50 g/l). The toner compounded with the additive had a coefficient of friction of 0.98.

COMPARATIVE EXAMPLE 10

A two-component developer was obtained in the same manner as in Example 7, except for replacing the spherical fine silica particles with hydrophobic colloidal silica having an average particle size of 0.5 μm and a coefficient of friction of 0.80 at 50 strokes and 0.92 at 5 strokes (bulk density: about 100 g/l). The toner compounded with the additives had a coefficient of friction of 0.95.

COMPARATIVE EXAMPLE 11

A two-component developer was obtained in the same manner as in Example 7, except for replacing the spherical fine silica particles with zinc stearate having an average particle size of 5.0 μm and a coefficient of friction of 0.35 at 50 strokes and 0.92 at 5 strokes. The toner compounded with the additives had a coefficient of friction of 0.82.

COMPARATIVE EXAMPLE 12

A two-component developer was obtained in the same manner as in Example 7, except for replacing the spherical fine silica particles with low-molecular polyethylene particles having an average particle size of about 9.0 μm and a coefficient of friction of 0.42 at 50 strokes and 0.95 at 5 strokes ("200P", obtained by freeze-grinding followed by classification). The toner compounded with the additives had a coefficient of friction of 0.85.

Each of the dry developers obtained in Examples 7 to 10 and Comparative Examples 8 to 12 was tested using a remodelled copying machine of "VIVACE 400" according the following test methods. The results obtained are shown in Table 3 below.

1) Coefficient of Friction

A coefficient of friction at 50 strokes was measured in accordance with the above-mentioned method of measurement. The coefficient of friction of toners compounded with additives is a coefficient of friction at 50 strokes.

2) Charging Properties

Measured in the same manner as in Example 1.

3) Cleaning Properties

Evaluated in the same manner as in Example 1.

4) Image Quality

After obtaining 100,000 copies, the image quality of the resulting copies and the surface condition of the photoreceptor were observed.

*1 . . . During and after obtaining 100,000 copies, neither image defects, such as black spots, black streaks and fog, nor scratches on the photoreceptor was observed.

*2 . . . From about the 800th copy, black streaks due to poor cleaning and black spots due to scratches on the photoreceptor developed.

*3 . . . From about the 200th copy, black streaks due to poor cleaning and black spots due to scratches on the photoreceptor developed.

*4 . . . From about the 800th copy, black streaks due to filming developed, and from the 50,000th copy fog due to insufficient charging was observed.

*5 . . . From about the 1,000th copy, black streaks due to filming developed.

5) Toner Impaction

From the developer was taken 100 g of the carrier and washed away electrostatically adhered toner particles with a Triton solution until the washing became free from turbidity. The carrier was then subjected to ultrasonic cleaning to remove toner particles which had strongly adhered or fused thereto and then weighed to obtain a toner impaction (mg/100 g-carrier).

TABLE 3

| Example No. | Flow-Improving Agent (Size) | Cleaning-Improving Agent: Kind (Size) | Cleaning-Improving Agent: Co-efficient of Friction | Toner's Coeffi-cient of Friction (μC/g) | Charge Quantity: Initial Stage (μC/g) | Charge Quantity: After Obtaining 100,000 Copies | Cleaning Properties | Image Quality | Toner Impaction (mg/100 g carrier) |
|---|---|---|---|---|---|---|---|---|---|
| Example 7 | titanium dioxide (0.05 μm) | spherical fine silica (0.70 μm) | 0.40 | 0.65 | 17 | 18 | G1 | *1 | 120 |
| Example 8 | hydrophobic colloidal silica (0.007 μm) | spherical fine silica (0.70 μm) | 0.60 | 0.78 | 10 | 10 | G2 | *1 | 270 |
| Example 9 | hydrophobic colloidal silica (0.007 μm) | spherical fine silica (0.05 μm) | 0.42 | 0.82 | 12 | 10 | G3 | *1 | 180 |
| Example 10 | hydrophobic colloidal silica (0.007 μm) | spherical fine silica (3.0 μm) | 0.60 | 0.82 | 11 | 12 | G3 | *1 | 500 |
| Comparative Example 8 | titanium dioxide (0.05 μm) | — | — | 0.98 | 18 | 17 | G4 | *2 | 1300 |
| Comparative Example 9 | hydrophobic colloidal silica (0.007 μm) | — | — | 0.98 | 13 | 12 | G5 | *3 | 1200 |
| Comparative Example 10 | titanium dioxide (0.05 μm) | hydrophobic colloidal silica (0.5 μm) | 0.80 | 0.95 | 8 | 6 | G5 | *3 | 1300 |
| Comparative Example 11 | titanium dioxide (0.05 μm) | zinc stearate (5.0 μm) | 0.35 | 0.82 | 18 | 6 | G3 | *4 | 2500 |
| Comparative Example 12 | titanium dioxide (0.05 μm) | low-mol. poly-ethylene (9.0 μm) | 0.42 | 0.85 | 18 | 17 | G3 | *5 | 2480 |

As can be seen from the results in Table 3, developers containing spherical fine particles having a coefficient of friction of not more than 0.60 at 50 strokes exhibit improved cleaning properties.

On further consideration, the cleaning-improving agent having a great difference between the coefficient of friction at 5 strokes and that at 50 strokes (Comparative Examples 11 and 12) undergoes filming by itself to reduce the coefficient of friction. Although the agent of this type reduces the interaction between a photoreceptor and a blade, it has a tendency of occurrence of white image defects or blurs due to the filming. On the other hand, most of cleaning-improving agents having a small difference of the above-mentioned coefficients of friction (Examples 7 to 10) reduce the coefficient of friction through rolling friction. The cleaning-improving agents of this type improve cleaning properties without causing scratches on the photoreceptor or undergoing filming and, at the same time, markedly reduce the toner impaction. It is thus seen that the coefficient of friction at 5 strokes is preferably not more than 0.70.

EXAMPLE 11

A hundred parts of spherical fine silica particles having an average particle size of 0.7 μm which was obtained by a deflagration method (bulk density: about 520 g/l) were surface-treated with 0.3 part of isopropyltriisostearoyl titanate to obtain titanium coupling agent-treated spherical fine silica particles.

| | |
|---|---|
| Styrene-butyl methacrylate copolymer (copolymerization ratio: 80/20) | 100 parts |
| Carbon black ("R-330") | 10 parts |

-continued

| | |
|---|---|
| Low-molecular polyethylene ("Viscol 660P") | 5 parts |
| Nigrosine ("Bontron N-04") | 1 part |

The above components were melt-kneaded in a Banbury mixer and, after cooling, finely ground in a jet mill. The grounds were classified in a classifier to obtain a toner having an average particle size of 11 μm.

A hundred parts of the toner were mixed with 1 part of fine titanium dioxide particles having an average particle size of 0.05 μm, and 0.5 part of the above-prepared treated spherical fine silica particles in a Henschel mixer to prepare a toner compounded with additives.

Separately, 90 parts of copper-zinc ferrite core particles having an average particle size of 80 μm were coated with 10 parts of a methylphenylsilicone polymer by means of a kneader coater to obtain a carrier.

Five parts of the toner and 100 parts of the carrier were mixed to obtain a two-component developer.

EXAMPLE 12

A developer was obtained in the same manner as in Example 11, except for replacing the isopropyltriisostearoyl titanate-treated spherical fine silica particles with titanium coupling agent-treated spherical fine silica particles obtained by treating spherical fine silica particles having an average particle size of 0.1 μm (bulk density: about 480 g/l) with isopropyltri(N-aminoethylaminoethyl) titanate.

EXAMPLE 13

A developer was obtained in the same manner as in Example 11, except for replacing the isopropyltriisostearoyl titanate-treated spherical fine silica particles with titanium coupling agent-treated spherical fine silica particles obtained by treating spherical fine silica particles having an average particle size of 3.0 μm (bulk density: about 520 g/l) with isopropyltris(dioctyl pyrophosphate) titanate.

EXAMPLE 14

To an ethanol solution containing 3 parts of hexyltriethoxysilane was added 100 parts of the same spherical fine silica particles as used in Example 11. After thoroughly stirring, ethanol was removed under reduced pressure to obtain hexyltriethoxysilane-treated spherical fine silica particles.

A developer was obtained in the same manner as in Example 11, except for replacing the titanium coupling agent-treated silica particles with the above-prepared silane coupling agent-treated silica particles.

EXAMPLE 15

A developer was obtained in the same manner as in Example 14, except for replacing the spherical fine silica particles having an average particle size of 0.7 μm with those having an average particle size of 0.1 μm (bulk density: about 400 g/l) and replacing 3.0 parts of hexyltriethoxysilane with 2.0 parts of γ-aminopropyltriethoxysilane and 2.0 parts of hexamethyldisilazane.

EXAMPLE 16

Spherical fine silica particles having an average particle size of 3.0 μm (bulk density: about 550 g/l) prepared by a deflagration method were reacted with octyltrimethoxysilane vapor in nitrogen gas and water vapor to obtain octyltrimethoxysilane-treated spherical fine silica particles.

A developer was obtained in the same manner as in Example 14, except for replacing the hexyltriethoxysilane-treated silica particles with the above-prepared octyltrimethoxysilane-treated silica particles.

EXAMPLE 17

A developer was obtained in the same manner as in Example 11, except for replacing the nigrosine dye with an azochromium complex ("Spiron Black TRH") and replacing the titanium dioxide fine particles with 0.8 part of hydrophobic colloidal silica having an average particle size of 0.012 μm ("RX 200").

EXAMPLE 18

A developer was obtained in the same manner as in Example 17, except for replacing the isopropyltriisostearoyl titanate-treated spherical fine silica particles with titanium coupling agent-treated spherical fine silica particles prepared by treating spherical fine silica particles having an average particle size of 0.05 μm (bulk density: about 350 g/l) with isopropyltridodecylbenzenesulfonyl titanate.

EXAMPLE 19

A developer was obtained in the same manner as in Example 17, except for replacing the titanium coupling agent-treated spherical fine silica particles with the same silane coupling agent-treated spherical fine silica particles as used in Example 14.

EXAMPLE 20

A developer was obtained in the same manner as in Example 17, except for replacing the titanium coupling agent-treated spherical fine silica particles with silane coupling agent-treated spherical fine silica particles prepared by treating spherical fine silica particles having an average particle size of 0.05 μm (bulk density: about 380 g/l) with vinyltrimethoxysilane.

Each of the developers obtained in Examples 11 to 20 and, for reference, the developers obtained in Comparative Examples 1, 2, 5, and 7 was tested in accordance with the following test methods. A remodelled copying machine of "VIVACE 400" was used for testing the developers of Examples 11 to 16 and Comparative Examples 1 and 2, and a remodelled copying machine of "FX-5039" was used for testing the developers of Examples 17 to 20 and Comparative Examples 5 and 7. The results obtained are shown in Table 4 below.

1) Charging Properties

The copying test was conducted under a high temperature and high humidity condition of 30° C. and 90% RH (hereinafter referred to as Condition I) or a low temperature and low humidity condition of 10° C. and 15% RH (hereinafter referred to as Condition II). The charge quantity was measured in the same manner as in Example 1.

2) Cleaning Properties

Evaluated in the same manner as in Example 1.

3) Image Quality

After obtaining 100,000 copies, the image quality of the resulting copies and the surface condition of the photoreceptor were observed.

| | |
|---|---|
| *1 | During and after obtaining 100,000 copies, neither image defects, such as black spots, black streaks and fog, nor scratches on the photoreceptor was observed. |
| *2 | From about the 800th copy, black streaks due to poor cleaning and black spots due to the scratches on the photoreceptor developed. |
| *3 | Black streaks due to filming occurred from about the 1000th copy. |
| *4 | Fog appeared under Condition I, and density reduction occurred under Condition III. |
| *5 | Black streaks due to poor cleaning and black spots due to scratches on the photoreceptor developed from about the 500th copy. |
| *6 | Black streaks due to filming developed from about the 800th copy. |

4) Toner Stability

After the 100,000 cycle copying test, occurrence of agglomeration of toner particles in the copying machine was inspected.

| | |
|---|---|
| G1 | No problem |
| G2 | Slight agglomeration of the toner occurred under Condition I. |
| G3 | Agglomeration of the toner occurred under Condition I. |

TABLE 4

| Example No. | Additive 1 (Size & Amount) (part) | Additive 2, Treating Agent* (Size & Amount) (part) | Charge Quantity (μC/g) Initial Stage | After Obtaining 100,000 Copies Condition I | Condition II | Cleaning Properties | Image Quality | Toner Stability |
|---|---|---|---|---|---|---|---|---|
| Example 11 | titanium dioxide (0.05 μm) (1.0) | spherical fine silica #1 (0.7 μm) (0.5) | 21 | 20 | 23 | G1 | *1 | G1 |
| Example 12 | titanium dioxide (0.05 μm) (1.0) | spherical fine silica #2 (0.1 μm) (0.5) | 24 | 22 | 25 | G1 | *1 | G1 |
| Example 13 | titanium dioxide (0.05 μm) (1.0) | spherical fine silica #3 (3.0 μm) (0.5) | 23 | 20 | 24 | G2 | *1 | G1 |
| Example 14 | titanium dioxide (0.05 μm) (1.0) | spherical fine silica #4 (0.7 μm) (0.5) | 22 | 19 | 23 | G1 | *1 | G1 |
| Example 15 | titanium dioxide (0.05 μm) (1.0) | spherical fine silica #5 (0.1 μm) (0.5) | 24 | 23 | 25 | G1 | *1 | G1 |
| Example 16 | titanium dioxide (0.05 μm) (1.0) | spherical fine silica #6 (3.0 μm) (0.5) | 22 | 20 | 24 | G2 | *1 | G1 |
| Comparative Example 1 | titanium dioxide (0.05 μm) (1.0) | — | 21 | 16 | 23 | G5 | *2 | G2 |
| Comparative Example 2 | titanium dioxide (0.05 μm) (1.0) | low-mol. polyethylene (9.0 μm) (0.5) | 23 | 9 | 18 | G4 | *3 | G3 |
| Example 17 | hydrophobic silica (0.012 μm) (0.8) | spherical fine silica #1 (0.7 μm) (0.5) | −17 | −16 | −19 | G1 | *1 | G1 |
| Example 18 | hydrophobic silica (0.012 μm) (0.8) | spherical fine silica #7 (0.05 μm) (0.5) | −18 | −15 | −19 | G2 | *1 | G1 |
| Example 19 | hydrophobic silica (0.012 μm) (0.8) | spherical fine silica #4 (0.7 μm) (0.5) | −15 | −13 | −18 | G1 | *1 | G1 |
| Example 20 | hydrophobic silica (0.012 μm) (0.8) | spherical fine silica #8 (0.05 μm) (0.5) | −14 | −13 | −17 | G2 | *1 | G1 |
| Comparative Example 5 | hydrophobic silica (0.012 μm) (0.8) | — | −19 | −10 | −18 | G5 | *5 | G2 |
| Comparative Example 7 | hydrophobic silica (0.012 μm) (0.8) | zinc stearate (5.0 μm) (0.5) | −19 | −4 | −9 | G3 | *4 | G2 |

In Table 4 above, the treating agents in Additives 2 are as follows.

| | |
|---|---|
| #1 | Isopropyltriisostearoyl titanate |
| #2 | Isopropyltri(N-aminoethylaminoethyl) titanate |
| #3 | Isopropyltris(dioctyl pyrophosphate) titanate |
| #4 | Hexyltriethoxysilane |

-continued

| | |
|---|---|
| #5 | γ-Aminopropyltriethoxysilane and hexamethyldisilazane |
| #6 | Octyltrimethoxysilane |
| #7 | Isopropyltridecylbenzenesulfonyl titanate |
| #8 | Vinyltrimethoxysilane |

It is seen from Table 4 that spherical fine silica particles treated with a titanium coupling agent, a silane coupling agent or an agent for rendering hydrophobic do not absorb moisture even under a high humidity condition so that the developers containing the same exhibit excellent environmental stability, being prevented from reduction in chargeability and powder fluidity.

| | |
|---|---|
| Resin Mixture | 100 parts |
| consisting of 60 parts of a styrene-butyl methacrylate (90/10) copolymer (molecular weight peak: $7.0 \times 10^3$; Mn: $4.0 \times 10^3$) as a low molecular polymer component and 40 parts of a styrene-butyl methacrylate (60/40) copolymer (molecular weight peak: $7.0 \times 10^5$; Mn: $2.2 \times 10^5$) as a high-molecular polymer component | |
| Carbon black ("R-330") | 10 parts |
| Low-molecular polypropylene ("Viscol 660P") | 5 parts |
| Charge control agent ("Bontron P-51" produced by Orient Kagaku Co., Ltd.) | 2 parts |

The above components were melt-kneaded in a Banbury mixer and, after cooling, finely ground in a jet mill, followed by classification to obtain a toner having an average particle size of 11 μm.

A hundred parts of the toner were mixed with 1 part of titanium dioxide fine particles having an average particle size of 0.05 μm and 0.5 part of spherical fine silica particles having an average particle size of 0.7 μm (bulk density: about 570 g/l) ("KMP-105") in a Henschel mixer to prepare a toner compounded with additives.

In 100 parts of dimethylformamide was dissolved parts of a vinylidene fluoride-hexafluoropropylene copolymer and spray-coated on 500 parts of spherical iron oxide powder having an average particle size of 100 μm in a fluidized bed coating apparatus. The solvent was then removed to obtain a carrier.

Five parts of the toner and 95 parts of the carrier were mixed to obtain a developer.

EXAMPLE 22

A developer was obtained in the same manner as in Example 21, except for replacing the spherical fine silica particles having an average particle size of 0.7 μm with those having an average particle size of 0.1 μm (bulk density: about 400 g/l).

EXAMPLE 23

A developer was obtained in the same manner as in Example 21, except for replacing the spherical fine silica particles having an average particle size of 0.7 μm with those having an average particle size of 0.05 μm (bulk density: about 350 g/l).

EXAMPLE 24

A developer was obtained in the same manner as in Example 21, except for replacing the spherical fine silica particles having an average particle size of 0.7 μm with those having an average particle size of 3.0 μm (bulk density: about 520 g/l).

EXAMPLE 25

A developer was obtained in the same manner as in Example 21, except for using as a binder resin a styrene-butyl acrylate copolymer having a single molecular weight peak at $1.9 \times 10^5$.

COMPARATIVE EXAMPLE 13

A developer was obtained in the same manner as in Example 21, except for using no spherical fine silica particles.

COMPARATIVE EXAMPLE 14

A developer was obtained in the same manner as in Example 21, except for replacing the spherical fine silica particles with low-molecular polyethylene particles having an average particle size of about 9.0 μm prepared by freeze-grinding low-molecular polyethylene ("200P"), followed by classification.

COMPARATIVE EXAMPLE 15

A developer was obtained in the same manner as in Example 21, except for replacing the spherical fine silica particles with zinc stearate particles having an average particle size of 5.0 μm.

COMPARATIVE EXAMPLE 16

A developer was obtained in the same manner as in Example 21, except for replacing the spherical fine silica particles with hard fine particles obtained by surface-treating silicon carbide particles having an average particle size of 5.0 μm (bulk density: about 1200 g/l) with a titanium coupling agent.

COMPARATIVE EXAMPLE 17

A developer was obtained in the same manner as in Example 21, except for replacing the spherical fine silica particles with hydrophobic colloidal silica fine particles having an average particle size of 0.016 μm (bulk density: about 50 g/l) ("R 972" produced by Nippon Aerosil Co., Ltd.).

Each of the developers obtained in Examples 21 to 25 and Comparative Examples 13 to 17 was tested in accordance with the following test methods by using a remodelled copying machine of "VIVACE 400". The results obtained are shown in Table 5 below.

1) Charging Properties

Measured in the same manner as in Example 1.

2) Cleaning Properties

Evaluated in the same manner as in Example 1.

3) Wear of Photoreceptor

Measured in the same manner as in Example 1. Grade "G5" given to Comparative Example 16 was attributed to a wear of the cleaning blade.

4) Toner Impaction

Measured in the same manner as in Example 7.

5) Fixing Temperature

The toner image was fixed with a heat roll set at a varied fixing temperature by means of a remodelled fixing apparatus of "FX-4700", and the fixed image was subjected to a rubbing test. The heat roll temperature giving a fixed image which withstood the rubbing test to leave a given residual image was taken as a fixing temperature.

6) Offsetting Temperature

The heat roll of the fixing apparatus was elevated from 200° C. by 5° C. up to 250° C., and occurrence of offset was observed with the naked eye. "No occurrence" means no offset was observed at 250° C.

7) Image Quality

After obtaining 100,000 copies, the image quality of the resulting copies and the surface condition of the photoreceptor were observed.

| | |
|---|---|
| *1 | During and after obtaining 100,000 copies, neither image defects, such as black spots, black streaks and fog, nor scratches on the photoreceptor was observed. |
| *2 | From about the 800th copy, black streaks due to poor cleaning and black spots due to the scratches on the photoreceptor developed. |
| *3 | From about the 1000th copy, black streaks due to filming developed. |
| *4 | From about the 800th copy, black streaks due to filming developed. |
| *5 | From about the 500th copy, black streaks due to filming and black spots due to scratches on the photoreceptor developed. |
| *6 | From about the 200th copy, black streaks due to poor cleaning and black spots due to scratches on the photoreceptor developed. |

The above components were melt-kneaded in a Banbury mixer and, after cooling, ground in a jet mill, followed by classification to obtain toner particles having an average particle size of 6 μm.

A hundred parts of the toner, 1 part of titanium dioxide fine particles having an average particle size of 0.05 μm, and 0.5 part of spherical fine silica particles having an average particle size of 0.7 μm ("KMP-105") were mixed in a Henschel mixer to prepare a toner.

Six parts of a vinylidene fluoride-hexafluoropropylene copolymer were dissolved in 100 parts of dimethylformamide to prepare a coating solution, and 500 parts of spherical iron oxide powder having an average particle size of 50 μm was fluidized in a fluidized bed coating apparatus and spray-coated with the solution. The solvent was removed to obtain a carrier.

Five parts of the toner and 95 parts of the carrier were mixed to prepare a developer.

EXAMPLE 27

TABLE 5

| Example No. | Additive 1 (Size) | Additive 2 (Size) | Mol. Wt. Peak Number of Binder Resin | Charge Quantity: Initial Stage (μC/g) | Charge Quantity: After Obtaining 100,000 Copies (μC/g) | Cleaning Properties | Wear of Photoreceptor (μm) | Toner Impaction (mg/100 g carrier) | Fixing Temp. (°C.) | Offset Temp. (°C.) | Image Quality |
|---|---|---|---|---|---|---|---|---|---|---|---|
| Example 21 | titanium dioxide (0.05 μm) | spherical fine silica (0.7 μm) | 2 | 19 | 18 | G1 | <1.0 | 180 | 148 | No occurrence | *1 |
| Example 22 | titanium dioxide (0.05 μm) | spherical fine silica (0.1 μm) | 2 | 20 | 16 | G1 | <1.0 | 290 | 150 | No occurrence | *1 |
| Example 23 | titanium dioxide (0.05 μm) | spherical fine silica (0.05 μm) | 2 | 19 | 16 | G2 | 4.0 | 210 | 150 | No occurrence | *1 |
| Example 24 | titanium dioxide (0.05 μm) | spherical fine silica (3.0 μm) | 2 | 21 | 19 | G3 | 1.0 | 510 | 150 | No occurrence | *1 |
| Example 25 | titanium dioxide (0.05 μm) | spherical fine silica (0.7 μm) | 1 | 19 | 18 | G1 | <1.0 | 120 | 175 | 230 | *1 |
| Comparative Example 13 | titanium dioxide (0.05 μm) | — | 2 | 20 | 19 | G5 | 40 | 1600 | 150 | No occurrence | *2 |
| Comparative Example 14 | titanium dioxide (0.05 μm) | low-mol. polyethylene (9.0 μm) | 2 | 23 | 20 | G4 | 10 | 2450 | 148 | No occurrence | *3 |
| Comparative Example 15 | titanium dioxide (0.05 μm) | zinc stearate (5.0 μm) | 2 | 24 | 22 | G3 | 10 | 2620 | 150 | No occurrence | *4 |
| Comparative Example 16 | titanium dioxide (0.05 μm) | Ti-coupling agent-treated silicon carbide (0.5 μm) | 2 | 18 | 15 | G5 | 60 | 1700 | 150 | No occurrence | *5 |
| Comparative Example 17 | titanium dioxide (0.05 μm) | hydrophobic silica (0.016 μm) | 2 | 15 | 12 | G5 | 50 | 1500 | 155 | 245 | *6 |

As is apparent from Table 5, the developer of Example 25 using a styrene-butyl acrylate copolymer having a single molecular weight peak has a higher fixing temperature and a lower hot offset temperature as compared with developers using a binder resin having two molecular weight peaks.

| | |
|---|---|
| Styrene-butyl acrylate copolymer (copolymerization ratio: 80/20) | 100 parts |
| Carbon black ("R330") | 10 parts |
| Low-molecular weight polypropylene ("Viscol 660P") | 5 parts |
| Charge control agent ("P-51") | 2 parts |

A developer as obtained in the same manner as in Example 26, except for replacing the spherical fine silica particles having an average particle size of 0.7 μm with those having an average particle size of 0.1 μm (bulk density: about 400 g/l).

EXAMPLE 28

A developer was obtained in the same manner as in Example 26, except for replacing the spherical fine silica particles having an average particle size of 0.7 μm with those having an average particle size of 0.05 μm (bulk density: about 350 g/l).

EXAMPLE 29

A developer was obtained in the same manner as in Example 26, except for replacing the spherical fine silica particles having an average particle size of 0.7 μm with those having an average particle size of 3.0 μm (bulk density: about 520 g/l).

EXAMPLE 30

A developer was obtained in the same manner as in Example 26, except for changing the average particle size of the toner to about 11 μm.

COMPARATIVE EXAMPLE 18

A developer was obtained in the same manner as in Example 26, except for using no spherical fine silica particles.

COMPARATIVE EXAMPLE 19

A developer was obtained in the same manner as in Example 26, except for replacing the spherical fine silica particles with aluminum oxide having an average particle size of 0.02 μm ("AOC" produced by Nippon Aerosil Co., Ltd.).

COMPARATIVE EXAMPLE 20

A developer was obtained in the same manner as in Example 26, except for replacing the spherical fine silica particles with hydrophobic colloidal silica fine particles having an average particle size of about 0.016 μm ("R 972").

COMPARATIVE EXAMPLE 21

A developer was obtained in the same manner as in Example 26, except for replacing the spherical fine silica particles with zinc stearate fine particles having an average particle size of about 5.0 μm.

Each of the developers obtained in Examples 26 to 30 and Comparative Examples 18 to 21 was tested according to the following test methods using a remodelled copying machine of "VIVACE 400". The results obtained are shown in Table 6 below.

1) Charging Properties

Measured in the same manner as in Example 1.

2) Developing Properties

A photoreceptor in the initial stage of copying having a charging level between 18 and 25 μC/g was developed to form thereon a solid image of a given density. The weight of the toner adhered per unit area of the photoreceptor was measured.

3) Transfer Efficiency

A transfer efficiency after obtaining 100,000 copies was obtained from equation:

$$\text{Transfer Efficiency (\%)} = \frac{\text{Toner Amount per Unit Area of Transferred Solid Image}}{\text{Toner Amount per Unit Area of Solid Image on Photoreceptor}}$$

4) Wear of Photoreceptor

Measured in the same manner as in Example 1.

5) Toner Consumption

The number of copies (paper size: A3; image: Japanese letters) which could be taken from 600 g of a toner was measured.

6) Fine Line Reproducibility Represented by equation:

$$\text{Fine Line Reproducibility} = \frac{\text{Thickness of Line after Fixing}}{\text{Thickness of Line of Original}}$$

7) Image Quality

After obtaining 100,000 copies, the image quality of the resulting copies and the surface condition of the photoreceptor were observed.

| | |
|---|---|
| *1 | During and after obtaining 100,000 copies, neither image defects, such as black spots, black streaks and fog, nor scratches on the photoreceptor was observed. |
| *2 | Unevenness of density and defects in a solid area occurred from about the 1000th copy. |
| *3 | Unevenness of density and defects in a solid area occurred from about the 2000th copy. |
| *4 | Unevenness of density and defects in a solid area occurred from about the 8000th copy. |
| *5 | Unevenness of density and defects in a solid area occurred from about the 1200th copy. |

TABLE 6

| Example No. | Additive 1 (Size) | Additive 2 (Size) | Size of Toner Particles (μm) | Charge Quantity: Initial Stage (μC/g) | Charge Quantity: After Obtaining 100,000 Copies (μC/g) | Developing Properties (mg/cm²) | Transfer Efficiency (%) | Wear of Photo-receptor (μm) | Toner Con-sump-tion | Fine Line Repro-duci-bility | Image Quality |
|---|---|---|---|---|---|---|---|---|---|---|---|
| Example 26 | titanium dioxide (0.05 μm) | spherical fine silica (0.7 μm) | 6 | 23 | 21 | 0.7 | 95 | <1.0 | 165000 | 1.1 | *1 |
| Example 27 | titanium dioxide (0.05 μm) | spherical fine silica (0.1 μm) | 6 | 24 | 19 | 0.7 | 95 | <1.0 | " | " | *1 |
| Example 28 | titanium dioxide (0.05 μm) | spherical fine silica (0.05 μm) | 6 | 23 | 19 | 0.6 | 90 | 4.0 | " | " | *1 |
| Example 29 | titanium dioxide (0.05 μm) | spherical fine silica (3.0 μm) | 6 | 25 | 23 | 0.6 | 85 | 1.0 | " | " | *1 |
| Example 30 | titanium dioxide (0.05 μm) | spherical fine silica (0.7 μm) | 11 | 19 | 18 | 1.0 | 98 | <1.0 | 90000 | 1.3 | *1 |
| Comparative Example 18 | titanium dioxide (0.05 μm) | — | 6 | 23 | 20 | 0.4 | 75 | 40 | 165000 | 1.1 | *2 |
| Comparative Example 19 | titanium dioxide | aluminum oxide | 6 | 19 | 16 | 0.4 | 70 | 50 | " | " | *3 |

TABLE 6-continued

| Example No. | Additive 1 (Size) | Additive 2 (Size) | Size of Toner Particles (μm) | Charge Quantity: Initial Stage (μC/g) | Charge Quantity: After Obtaining 100,000 Copies (μC/g) | Developing Properties (mg/cm²) | Transfer Efficiency (%) | Wear of Photo-receptor (μm) | Toner Con-sump-tion | Fine Line Repro-duci-bility | Image Quality |
|---|---|---|---|---|---|---|---|---|---|---|---|
| Comparative Example 20 | (0.05 μm) titanium dioxide (0.05 μm) | (0.02 μm) hydrophobic silica (0.016 μm) | 6 | 18 | 15 | 0.5 | 75 | 50 | " | " | *4 |
| Comparative Example 21 | titanium dioxide (0.05 μm) | zinc stearate (5.0 μm) | 6 | 24 | 16 | 0.3 | 65 | 10 | " | " | *5 |

As is apparent from Table 6, as the particle size of a toner increases, the toner consumption also increases, and all the developers of Comparative Examples had a poor transfer efficiency.

EXAMPLE 31

| | |
|---|---|
| Styrene-butyl acrylate copolymer (copolymerization ration: 80/20) | 100 parts |
| Carbon black ("R-330") | 10 parts |
| Low-molecular polypropylene ("Viscol 660P") | 5 parts |
| Charge control agent ("Bontron P-51") | 1 part |

The above components were melt-kneaded in a Banbury mixer and, after cooling, ground in a jet mill, followed by classification to obtain toner particles having an average particle size of 11 μm. A hundred parts of the toner, 1 part of titanium dioxide fine particles having an average particle size of 0.05 μm, and 0.5 part of spherical fine silica particles having an average particle size of 0.7 μm (bulk density: about 500 g/l) were mixed in a Henschel mixer to prepare a toner.

| | |
|---|---|
| Magnetite ("EPT-1000" produced by Toda Kogyo Co., Ltd.) | 70 parts |
| Styrene-butyl methacrylate copolymer (copolymerization ratio: 80/20) | 24 parts |
| Polyvinylene fluoride ("KYNAR" produced by Penn Walt Corp.) | 6 parts |

The above components were melt-kneaded in a pressure kneader, ground in a turbo-mill, and classified to obtain a carrier having an average particle size of 50 μm.

Ten parts of the toner and 90 parts of the carrier were mixed to prepare a two-component developer.

EXAMPLE 32

A hundred parts of the same toner (average particle size: 11 μm) as obtained in Example 31, 0.5 part of hydrophobic colloidal silica having an average particle size of 0.007 μm ("R 812"), and 0.5 part of spherical fine silica particles having an average particle size of 0.7 μm (bulk density: about 500 g/l) were mixed and dispersed in a Henschel mixer to prepare a toner.

Ten parts of the toner and 90 parts of the same carrier as used in Example 31 were mixed to obtain a two-component developer.

EXAMPLE 33

A hundred parts of the same toner (average particle size: 11 μm) as obtained in Example 31 and 1 part of titanium dioxide having an average particle size of 0.05 μm were mixed in a Henschel mixer to prepare a toner.

The same magnetic carrier as used in Example 31 was mixed with 0.1% of spherical fine silica particles having an average particle size of 0.7 μm (bulk density: about 500 g/l) in a twin-cylinder mixer.

Ten parts of the toner and 90 parts of the thus treated carrier were mixed to obtain a two-component developer.

EXAMPLE 34

Ten parts of the same toner as obtained in Example 33, 0.1 part of spherical fine silica particles having an average particle size of 0.7 μm (bulk density: about 500 g/l), and 89.9 parts of the same magnetic carrier as obtained in Example 31 were mixed in a twin-cylinder mixer to obtain a two-component developer.

COMPARATIVE EXAMPLE 22

A two-component developer was obtained in the same manner as in Example 31, except for using no spherical fine silica particles as an external additive for the toner.

COMPARATIVE EXAMPLE 23

A two-component developer was prepared in the same manner as in Example 31, except for using no spherical fine silica particles as an external additive for the carrier.

COMPARATIVE EXAMPLE 24

A two-component developer was prepared in the same manner as in Example 31, except for replacing the spherical fine silica particles with zinc stearate fine particles having an average particle size of about 5.0 μm.

COMPARATIVE EXAMPLE 25

A two-component developer was prepared in the same manner as in Example 31, except for replacing the spherical fine silica particles with low-molecular polyethylene particles having an average particle size of about 9.0 μm prepared by freeze-grinding ("200P"), followed by classification).

Each of the developers obtained in Examples 31 to 34 and Comparative Examples 22 to 25 was tested in accordance with the following test methods by using a remodelled copying machine of "ABLE-3300" (manufactured by Fuji Xerox Co., Ltd.). The results obtained are shown in Table 7 below.

1) Scratches on Photoreceptor

After obtaining 20,000 copies, the surface of the photoreceptor was observed under a magnifier.

*1 During and after obtaining 20,000 copies, no

-continued

| | |
|---|---|
| | scratch on the photoreceptor was observed. |
| *2 | A number of scratches occurred on the surface of the photoreceptor which were ascribable to the released magnetic powder and the adhered carrier. |
| *3 | Toner filming occurred on the surface of the photoreceptor. |

2) Image Quality

After obtaining 10,000 copies, the image quality of the resulting copies and the surface condition of the photoreceptor were observed.

| | |
|---|---|
| *1 | During and after obtaining 10,000 copies, neither image defects, such as black spots, black streaks, and fog, nor scratches on the photoreceptor was observed. |
| *2 | Black streaks and black spots due to poor cleaning developed from about the 200th copy. |
| *3 | Partial fog developed from about the 100th copy, and entire fog developed from about the 200th copy. |
| *4 | Partial fog developed from about the 200th copy. |

TABLE 7

| Example No. | Toner Flow-Improving Agent (Size) | Interaction Depressant (Size) | Manner of Treatment* | Scratches on Photo-receptor | Image Quality |
|---|---|---|---|---|---|
| Example 31 | titanium dioxide (0.05 μm) | spherical fine silica (0.7 μm) | treatment on toner | *1 | *1 |
| Example 32 | hydrophobic silica (0.007 μm) | spherical fine silica (0.7 μm) | treatment on toner | " | " |
| Example 33 | titanium dioxide (0.05 μm) | spherical fine silica (0.7 μm) | treatment on carrier | " | " |
| Example 34 | titanium dioxide (0.05 μm) | spherical fine silica (0.7 μm) | addition at the preparation of a developer | " | " |
| Comparative Example 22 | titanium dioxide (0.05 μm) | — | — | *2 | *2 |
| Comparative Example 23 | hydrophobic silica (0.007 μm) | — | — | *2 | *2 |
| Comparative Example 24 | titanium dioxide (0.05 μm) | zinc stearate (5.0 μm) | treatment on toner | *3 | *3 |
| Comparative Example 25 | titanium dioxide (0.05 μm) | low-mol. polyethylene (9.0 μm) | treatment on toner | *3 | *4 |

Note: *The manner of using the interaction depressant (cleaning-improving agent).

As can be seen from Table 7, developers using a magnetic powder-containing carrier are also excellent in image quality and keeping a photoreceptor in a good condition.

EXAMPLE 35

| | |
|---|---|
| Styrene-butyl acrylate copolymer (copolymerization ratio: 70/30) | 49 parts |
| Magnetic powder ("EPT-1000") | 45 parts |
| Low-molecular polyethylene ("Viscol 660P") | 4 parts |
| Charge control agent ("P-51") | 2 parts |

The above components were dry blended in a Henschel mixer, and the blend was melt-kneaded in an extruder. After cooling, the blend was ground and classified to obtain toner particles having an average particle size of 11 μm.

A hundred parts of the toner were mixed with 0.4 part of hydrophobic silica fine particles having an average particle size of 0.012 μm, and 0.5 part of spherical fine silica particles having an average particle size of 0.7 μm ("KMP-105", bulk density: about 570 g/l) in a Henschel mixer to prepare a one-component developer.

EXAMPLE 36

A one-component developer was prepared in the same manner as in Example 35, except for replacing the spherical fine silica particles having an average particle size of 0.7 μm with those having an average particle size of 0.1 μm (bulk density: about 400 g/l).

EXAMPLE 37

A one-component developer was prepared in the same manner as in Example 35, except for replacing the spherical fine silica particles having an average particle size of 0.7 μm with those having an average particle size of 0.05 μm (bulk density: about 350 g/l).

EXAMPLE 38

A one-component developer was prepared in the same manner as in Example 35, except for replacing the spherical fine silica particles having an average particle size of 0.7 μm with those having an average particle size of 3.0 μm (bulk density: about 520 g/l).

COMPARATIVE EXAMPLE 26

A one-component developer was prepared in the same manner as in Example 35, except for using no spherical fine silica particles.

COMPARATIVE EXAMPLE 27

A one-component developer was prepared in the same manner as in Example 35, except for replacing the spherical fine silica particles with low-molecular polyethylene particles having an average particle size of about 9.0 μm prepared by freeze-grinding ("200P"), followed by classification.

COMPARATIVE EXAMPLE 28

A one-component developer was prepared-in the same manner as in Example 35, except for replacing the spherical fine silica particles with zinc stearate particles having an average particle size of about 5.0 μm.

COMPARATIVE EXAMPLE 29

A one-component developer was prepared in the same manner as in Example 35, except for replacing the spherical fine silica particles with titanium dioxide particles having an average particle size of about 0.05 pm.

Each of the developers obtained in Examples 35 to 38 and Comparative examples 26 to 29 was tested according to the following test methods by using a remodelled copying machine of "FX-2700" manufactured by Fuji Xerox Co., Ltd. The results obtained are shown in Table 8 below.

1) Image Density

After adjusting the initial image density to a Macbeth density of from 1.2 to 1.3 (as measured with a Macbeth densitometer manufacture by Macbeth Corp.), 5,000 copies were produced, and a hundred copies were sampled for every 50 copies. The optical density of the sample copies was measured, and the lowest of the measured values was ranked as follows.

| | |
|---|---|
| G1 | 1.0 or higher |
| G2 | 0.85 or higher and less than 1.0 |
| G3 | less than 0.85 |

2) Cleaning Properties

A 5 cm wide black band was formed on the photoreceptor as a toner image, and, without being transferred, the toner image was wiped off with a cleaning blade. The cleaning test (stress test) of 999 cycles was repeated 2 times. Developer samples rated "G1" to "G3" are acceptable in ordinary copying processing. Developer samples rated "G4" or "G5" cause poor cleaning in ordinary copying processing.

| | |
|---|---|
| G1 | The toner on the photoreceptor was completely cleaned with no problem. |
| G2 | Poor cleaning was slightly observed from the 1800th cycle. |
| G3 | Poor cleaning occurred from the 1200th to 1799th cycle. |
| G4 | Poor cleaning occurred from the 300th to 1199th cycle. |
| G5 | Poor cleaning occurred on or before the 299th cycle. |

3) Wear of Photoreceptor

After obtaining 5,000 copies, the wear of the photoreceptor (μm) was measured.

4) Image Quality

After obtaining 5,000 copies, the image quality of the resulting copies and the surface condition of the photoreceptor were observed.

| | |
|---|---|
| *1 | During and after obtaining 5,000 copies, neither image defects, such as black spots, black streaks, and fog, nor scratches on the photoreceptor was observed. |
| *2 | Black streaks due to poor cleaning and black spots due to scratches on the photoreceptor developed from about the 550th copy. |
| *3 | Black spots due to filming occurred from about the 900th copy. |
| *4 | Black spots due to filming occurred from about the 700th copy. |
| *5 | Black streaks due to poor cleaning and black spots due to scratches on the photoreceptor developed from about the 150th copy. |

TABLE 8

| Example No. | Additive 1 (Size) | Additive 2 (Size) | Image Density | Cleaning Properties | Wear of Photo-receptor (μm) | Image Quality |
|---|---|---|---|---|---|---|
| Example 35 | hydrophobic silica (0.012 μm) | spherical fine silica (0.7 μm) | G1 | G1 | 25 | *1 |
| Example 36 | hydrophobic silica (0.012 μm) | spherical fine silica (0.1 μm) | G1 | G1 | 26 | *1 |
| Example 37 | hydrophobic silica (0.012 μm) | spherical fine silica (0.05 μm) | G1 | G2 | 30 | *1 |
| Example 38 | hydrophobic silica (0.012 μm) | spherical fine silica (3.0 μm) | G1 | G3 | 34 | *1 |
| Comparative Example 26 | hydrophobic silica (0.012 μm) | — | G2 | G5 | 120 | *2 |
| Comparative Example 27 | hydrophobic silica (0.012 μm) | low-mol. polyethylene (9.0 μm) | G1 | G4 | 76 | *3 |
| Comparative Example 28 | hydrophobic silica (0.012 μm) | zinc stearate (5.0 μm) | G1 | G3 | 92 | *4 |
| Comparative Example 29 | hydrophobic silica (0.012 μm) | titanium dioxide (0.05 μm) | G3 | G5 | 180 | *5 |

As is apparent from the results in Table 8, the one-component developers containing magnetic powder of Examples 35 to 38 exhibit satisfactory cleaning properties and provide images of excellent quality without impairing the image density or causing a serious wear of the photoreceptor.

EXAMPLE 39

In Example 39 and Examples 40 to 45 hereinafter described, mixing in a Henschel mixer was carried out at a peripheral speed of 40 m/sec for 15 minutes, and that in a twin-cylinder mixer was carried out at 40 rpm for 20 minutes.

| | |
|---|---|
| Styrene-butyl acrylate copolymer (copolymerization ratio: 80/20) | 60 parts |
| Carbon black ("R-330") | 10 parts |
| Low-molecular polypropylene ("Viscol 660P") | 5 parts |
| Charge control agent ("P-51") | 2 parts |

The above components were melt-kneaded in a Banbury mixer and, after cooling, finely ground in a jet mill, followed by classification to obtain a toner having an average particle size of 11 μm.

A hundred parts of the toner was mixed with 1 part of titanium dioxide fine particles having an average particle size of 0.05 μm in a Henschel mixer (first stage). The resulting toner particles were then mixed with 0.5 part of spherical fine silica particles having an average particle size of 0.7 μm ("KMP-105") in a Henschel mixer to prepare a toner (second stage).

Separately, 4 parts of a vinylidene fluoride-hexafluoropropylene copolymer was dissolved in 100 parts of dimethylformamide to prepare a coating solution. Five hundred parts of spherical iron particles having an average particle size of 100 μm were fluidized in a fluidized bed coating apparatus and spray-coated with the coating solution. The solvent was removed to obtain a carrier.

Five parts of the toner and 95 parts of the carrier were mixed to obtain a developer.

EXAMPLE 40

A developer was obtained in the same manner as in Example 39, except that one part of titanium dioxide particles having an average particle size of 0.05 μm was added and mixed in a twin-cylinder mixer in the first stage, and then 0.5 part of spherical fine silica particles having an average particle size of 0.7 μm ("KMP-105") was added and mixed in a twin-cylinder mixer in the second stage.

EXAMPLE 41

A developer was obtained in the same manner as in Example 39, except that the titanium dioxide fine particles was added and mixed in a Henschel mixer in the first stage and then the spherical fine silica particles was added and mixed in a twin-cylinder mixer in the second stage.

EXAMPLE 42

A developer was obtained in the same manner as in Example 39, except that the titanium dioxide and the spherical fine silica particles were added at the same time and mixed in a Henschel mixer.

EXAMPLE 43

A developer was obtained in the same manner as in Example 39, except that the titanium dioxide and the spherical fine silica particles were added at the same time and mixed in a twin-cylinder mixer.

EXAMPLE 44

A developer was obtained in the same manner as in Example 39, except that 0.5 part of spherical fine silica particles having an average particle size of 0.7 μm ("KMP-105") was added and mixed in a Henschel mixer in the first stage, and 1 part of titanium dioxide particles having an average particle size of 0.05 μm was then added and mixed in a Henschel mixer in the second stage.

EXAMPLE 45

A developer was obtained in the same manner as in Example 39, except that 0.5 part of spherical fine silica particles having an average particle size of 0.7 μm ("KMP-105") was added and mixed in a twin-cylinder mixer in the first stage and 0.5 part of titanium dioxide particles having an average particle size of 0.05 μm was added and mixed in a twin-cylinder mixer in the second stage.

Each of the developers obtained in Examples 39 to 45 was tested in accordance with the following test-methods by means of a remodelled copying machine of "VIVACE 400". The results obtained are shown in Table 9 below.

1) Charging Properties

Measured in the same manner as in Example 1.

2) Toner Fluidity

Testing was carried out by means of an auger-type toner transport system. The weight (g) of the toner transported for 1 minute was taken as an indication of toner fluidity. The higher the toner weight, the better the toner fluidity. A toner with good fluidity is excellent in response to automatic density control.

3) Cleaning Properties

A 5 cm wide black band was formed on the photoreceptor as a toner image, and, without being transferred, the toner image was wiped off with a cleaning blade. The cleaning test of 999 cycles was repeated 4 times. This test is a kind of stress test so that developers rated "G1" to "G3" are acceptable in ordinary copying processing.

| | |
|---|---|
| G1 | The toner on the photoreceptor was completely cleaned without any problem. |
| G2 | Poor cleaning was slightly observed from the 3500th cycle. |
| G3 | Poor cleaning occurred from the 1500th to 3499th cycle. |

4) Wear of Photoreceptor

After obtaining 200,000 copies, the wear (μm) of the photoreceptor was measured.

5) Image Quality

After obtaining 200,000 copies, the image quality of the resulting copies and the surface condition of the photoreceptor were observed.

| | |
|---|---|
| *1 | During and after obtaining 200,000 copies, neither image defects, such as black spots, black streaks, and fog, nor scratches on the photoreceptor was observed. |
| *2 | Black streaks due to poor cleaning and black spots due to scratches on the photoreceptor developed from about the 150,000th copy. |
| *3 | Black streaks due to poor cleaning and black spots due to scratches on the photoreceptor occurred from about the 135,000th copy. |
| *4 | Black streaks due to poor cleaning and black |

-continued

| | |
|---|---|
| | spots due to scratches on the photoreceptor occurred from about the 120,000th copy. |
| *5 | Black streaks due to poor cleaning and black spots due to scratches on the photoreceptor developed from about the 115,000th copy. |

TABLE 9

| Example No. | Additive of 1st Addition (Means for Addition) | Additive of 2nd Addition (Means for Addition) | Toner Fluidity (g/min) | Charge Quantity Initial Stage (μC/g) | Charge Quantity After Obtaining 200,000 Copies (μC/g) | Cleaning Property | Wear of Photo-receptor (μm) | Image Quality |
|---|---|---|---|---|---|---|---|---|
| Example 39 | titanium dioxide (Henschel mixer) | spherical fine silica (Henschel mixer) | 35 | 20 | 18 | G2 | 2.0 | *1 |
| Example 40 | titanium dioxide (twin-cylinder mixer) | spherical fine silica (twin-cylinder mixer) | 36 | 19 | 17 | G2 | 2.0 | *1 |
| Example 41 | titanium dioxide (Henschel mixer) | spherical fine silica (twin-cylinder mixer) | 40 | 20 | 19 | G1 | <1.0 | *1 |
| Example 42 | simultaneous addition of titanium dioxide and spherical fine silica (Henschel mixer) | | 32 | 19 | 17 | G2 | 1.0 | *2 |
| Example 43 | simultaneous addition of titanium dioxide and spherical fine silica (twin-cylinder mixer) | | 30 | 20 | 17 | G2 | 2.0 | *3 |
| Example 44 | spherical fine silica (Henschel mixer) | titanium oxide (Henschel mixer) | 27 | 20 | 15 | G3 | 3.0 | *4 |
| Example 45 | spherical fine silica (twin-cylinder mixer) | titanium oxide (twin-cylinder mixer) | 28 | 21 | 16 | G3 | 4.0 | *5 |

As is apparent from Table 9, the excellent characteristics of the spherical silica particles can be displayed more sufficiently when added according to a mode in which an inorganic compound other than the spherical silica particles is added in a first stage and the spherical silica is added in a second stage (Examples 39 to 41) than when added according to other modes of addition.

EXAMPLE 46

| | |
|---|---|
| Styrene-butyl acrylate copolymer (copolymerization ratio: 80/20) | 100 parts |
| Carbon black ("R-330") | 10 parts |
| Low-molecular polypropylene ("Viscol 660P") | 5 parts |
| Charge control Agent ("Bontron P-51") | 1 part |

The above components were melt-kneaded in a Banbury mixer and, after cooling, finely ground in a jet mill. The grounds were classified in a classifier to obtain a toner having an average particle size of 11 μm.

A hundred parts of the toner were mixed with 1 part of fine titanium dioxide particles having an average particle size of 0.05 μm and 0.5 part of spherical fine silica particles having an average particle size of 0.7 μm ("KMP-105") in a Henschel mixer to prepare a toner compounded with additives.

Separately, spherical ferrite core particles having an average particle size of 50 μm were coated with a styrene-butyl acrylate copolymer (copolymerization ratio: 80/20) by means of a kneader coater to obtain a carrier.

Five parts of the toner and 95 parts of the carrier were mixed to obtain a two-component developer.

EXAMPLE 47

A hundred parts of the same toner as prepared in Example 46 (before compounding of additives) were mixed with 0.5 part of hydrophobic colloidal silica having an average particle size of 0.007 μm ("R 812") and 0.5 part of spherical fine silica particles having an average particle size of 3.0 μm (bulk density: about 520 g/l) in a Henschel mixer to prepare a toner.

The resulting toner and the same carrier as used in Example 46 were mixed at a weight ratio of 5/95 to obtain a two-component developer.

EXAMPLE 48

A hundred parts of the same toner as prepared in Example 46 (before compounding of additives) were mixed with 0.5 part of hydrophobic colloidal silica having an average particle size of 0.007 μm ("R 812") and 0.5 part of spherical fine silica particles having an average particle size of 0.05 μm (bulk density: about 350 g/l) in a Henschel mixer to prepare a toner.

The resulting toner and the same carrier as used in Example 46 were mixed at a weight ratio of 5/95 to obtain a two-component developer.

COMPARATIVE EXAMPLE 30

A two-component developer was obtained in the same manner as in Example 46, except for using no spherical fine silica particles.

COMPARATIVE EXAMPLE 31

A two-component developer was obtained in the same manner as in Example 47, except for using no spherical fine silica particles.

COMPARATIVE EXAMPLE 32

A two-component developer was obtained in the same manner as in Example 46, except for replacing the spherical fine silica particles with zinc stearate fine particles having an average particle size of about 5.0 μm.

COMPARATIVE EXAMPLE 33

A two-component developer was obtained in the same manner as in Example 46, except for replacing the spherical fine silica particles with low-molecular polyethylene particles having an average particle size of about 9.0 μm obtained by freeze-grinding ("200P") and classification.

COMPARATIVE EXAMPLE 34

A two-component developer was obtained in the same manner as in Example 46, except for replacing the spherical fine silica particles with polymethyl methacrylate particles having an average particle size of about 0.5 μm.

COMPARATIVE EXAMPLE 35

A two-component developer was obtained in the same manner as in Example 46, except for replacing the spherical fine silica particles with titanium coupling agent-treated silicon carbide fine particles having an average particle size of about 0.5 μm.

Each of the two-component developers obtained in Examples 46 to 48 and Comparative Examples 30 to 35 was subjected to a continuous copying test using a remodelled copying machine of "FX-5075" using an organic belt photoreceptor and a blade cleaning apparatus. The results obtained are shown in Table 10 below.

1) Charging Properties

Measured in the same manner as in Example 1.

2) Cleaning Properties

Evaluated in the same manner as in Example 1.

3) Image Quality

After obtaining 100,000 copies, the image quality of the resulting copies and the surface condition of the photoreceptor were observed.

| | |
|---|---|
| *1 | During and after obtaining 100,000 copies, neither image defects, such as black spots, black streaks, and fog, nor scratches on the photoreceptor was observed. |
| *2 | Black streaks due to poor cleaning and black spots due to scratches on the photoreceptor developed from about the 800th copy. |
| *3 | Black streaks due to poor cleaning and black spots due to scratches on the photoreceptor occurred from about the 200th copy. |
| *4 | Black streaks due to filming occurred from about the 800th copy, and fog due to insufficient charging occurred from about the 50,000th copy. |
| *5 | Black streaks due to filming occurred from about the 1000th copy. |
| *6 | Black streaks due to filming occurred from about the 2000th copy. |
| *7 | Edge fog due to wear of the photoreceptor occurred from about the 20,000th copy, and poor cleaning due to scratches of the blade occurred from about the 2,000th copy. |

TABLE 10

| Example No. | Flow-Improving Agent (Size) | Cleaning-Improving Agent (Size) | Charge Quantity: Initial Stage (μC/g) | Charge Quantity: After Obtaining 100,000 Copies (μC/g) | Cleaning Properties | Image Quality |
|---|---|---|---|---|---|---|
| Example 46 | titanium dioxide (0.05 μm) | spherical fine silica (0.7 μm) | 18 | 16 | G1 | *1 |
| Example 47 | hydrophobic silica (0.007 μm) | spherical fine silica (3.0 μm) | 12 | 10 | G3 | *1 |
| Example 48 | hydrophobic silica (0.007 μm) | spherical fine silica (0.05 μm) | 13 | 10 | G2 | *1 |
| Comparative Example 30 | titanium dioxide (0.05 μm) | — | 18 | 17 | G4 | *2 |
| Comparative Example 31 | hydrophobic silica (0.007 μm) | — | 13 | 12 | G5 | *3 |
| Comparative Example 32 | titanium dioxide (0.05 μm) | zinc stearate (5.0 μm) | 18 | 6 | G3 | *4 |
| Comparative Example 33 | titanium dioxide (0.05 μm) | low-mol. polyethylene (9.0 μm) | 18 | 17 | G3 | *5 |
| Comparative Example 34 | titanium dioxide (0.05 μm) | polymethyl methacrylate (0.5 μm) | 20 | 14 | G3 | *6 |
| Comparative Example 35 | titanium dioxide (0.05 μm) | Ti-coupling agent-treated silicon carbide | 19 | 15 | G3 | *7 |

According to the present invention, the toner having adhered thereto spherical fine silica particles having a bulk density of not less than 300 g/l and especially those prepared by a deflagration method and having an average particle size of from 0.05 to 3.0 μm can be prevented from filming on account of the hardness and resistance to deformation of the spherical fine silica particles. The spherical fine silica particles form moderate gaps between toner particles and other objects and contact with toner particles, a photoreceptor, or a charge-imparting member with a very small contact area because of their sphericity, to thereby greatly reduce the adhesive force of the toner.

The spherical fine silica particles serve as a roller and are therefore less liable to be buried in toner particles even under a high stress (e.g., under a high load and/or at a high speed). Even if somewhat buried, they are easily released therefrom and restored. As a result, the developer according to the present invention exhibits satisfactory fluidity, satisfactory cleaning properties, excellent environmental stability, and excellent durability for an extended period of time. Further, the toner particles having adhered the spherical fine silica particles undergo no filming phenomenon on the surface of a photoreceptor, the surface of a carrier which is used in a two-component development system, or the surface of a charge-imparting member which is used in a one-component development system. Therefore, the developer has a prolonged working life with high reliability, providing copies free from image defects, such as white spots and blurs.

In particular, where spherical fine silica particles having a coefficient of friction of not more than 0.60 are used, the developer exhibits improved cleaning properties due to the reduced interaction with the surface of a photoreceptor, the toner or the cleaning member. Besides the improvement in cleaning properties, toner impaction can also be prevented to thereby further prolong the working life of the developer. Where spherical fine silica particles having been treated with a coupling agent or having been rendered hydrophobic are used, the developer exhibits improved environmental stability and storage stability.

Where a toner whose volume average particle size ranging from 4 to 10 μm is used for obtaining high image quality, the addition of the spherical fine silica particles brings about improvements in developing and transfer performance, leading to a reduction in toner consumption.

Where the spherical fine silica particles are used for a toner containing a styrene-acrylic copolymer having two molecular weight peaks, one ranging from 1000 to 50,000 and the other from 100,000 to 1,000,000, as a binder resin, the resulting developer exhibits fixability at a reduced temperature while being freed of impaction or filming onto a charge-imparting member or a photoreceptor.

When the developer of the present invention is applied to a magnetic system using magnetic particles as a carrier or a toner component, occurrences of scratches on the surface of a photoreceptor can be reduced.

When the developer is prepared by mixing a toner with an inorganic compound and the spherical fine silica particles in the respective stage, the above-mentioned characteristics possessed by the spherical fine silica particles can be taken full advantage of.

In an electrophotographic process consisting of forming an electrostatic latent image on a photoreceptor, visualizing the latent image with a toner, transferring the toner image to a transfer material, and removing the toner remaining on the photoreceptor with a cleaning member, where a belt photoreceptor having seams is used, the developer of the present invention can be cleaned from such a photoreceptor without involving insufficient cleaning at the seams.

While the invention has been described in detail and with reference to specific examples thereof, it will be apparent to one skilled in the art that various changes and modifications can be made therein without departing from the spirit and scope thereof.

What is claimed is:

1. A developer for developing an electrostatic latent image, said developer comprising (i) a toner containing at least a binder resin and a colorant, and (ii) substantially spherical silica fine particles having a bulk density of not less than 300 g/l.

2. A developer as claimed in claim 1, wherein said substantially spherical silica fine particles have a coefficient of friction of not more than 0.6.

3. A developer as claimed in claim 1, wherein said substantially spherical silica fine particles have been treated with a coupling agent.

4. A developer as claimed in claim 1, wherein said substantially spherical silica fine particles have been rendered hydrophobic.

5. A developer as claimed in claim 1, wherein said binder resin of the toner is a styrene-acrylic resin having two molecular weight peaks, one of which is in the range of from 1000 to 50,000 and the other is in the range of from 200,000 to 1,000,000.

6. A developer as claimed in claim 1, wherein said toner has a volume-average particle size of from 4 to 8 μm.

7. A developer as claimed in claim 1, wherein said developer further comprises magnetic particles as a carrier, said magnetic particles comprising a resin having dispersed therein fine particles of a magnetic substance.

8. A developer as claimed in claim 1, wherein said toner is a magnetic toner comprising a resin having dispersed therein fine particles of a magnetic substance.

9. A developer as claimed in claim 8, wherein said magnetic toner has a volume-average particle size of not more than 20 μm.

10. A developer as claimed in claim 1, wherein said spherical silica fine particles have a minor axis to major axis ratio of 0.8 or more and a degree of sphericity Ψ of 0.6 or more.

11. A developer as claimed in claim 1, wherein said spherical silica fine particles have a minor axis to major axis ratio of 0.9 or more and a degree of sphericity Ψ of 0.8 or more.

12. A developer as claimed in claim 1, wherein said spherical fine silica particles have an average particle size of from 0.05 to 3.0 μm.

13. A developer as claimed in claim 1, wherein said spherical silica fine particles have an average particle size of from 0.1 to 1.0 μm.

14. A process for producing a developer for developing an electrostatic latent image comprising the steps of: adding inorganic compound particles to a toner containing at least a binder resin and a colorant; and then, in a separate stage, adding substantially spherical silica fine particles having a bulk density of not less than 300 g/l to said toner.

15. A process as claimed in claim 14, wherein said inorganic compound particles has an average particle size of not more than 0.1 μm.

16. A process as claimed in claim 14, wherein said spherical fine particles have a minor axis to major axis ratio of 0.8 or more and a degree of sphericity Ψ of 0.6 or more.

17. A process as claimed in claim 14, wherein said spherical silica fine particles have a minor axis to major axis ratio of 0.9 or more and a degree of sphericity Ψ of 0.8 or more.

18. A process as claimed in claim 14, wherein said spherical fine silica particles have an average particle size of from 0.05 to 3.0 μm.

19. A process as claimed in claim 14, wherein said spherical silica fine particles have an average particle size of from 0.1 to 1.0 μm.

20. A process for forming a toner image comprising the steps of:

forming an electrostatic latent image on a belt photoreceptor;

developing said latent image with a developer to form a toner image;

transferring said toner image to a transfer material; and cleaning said belt photoreceptor with a cleaning member to remove a residual toner, said developer comprising (i) a toner containing at least a binder resin and a colorant, and (ii) substantially spherical silica fine particles having a bulk density of not less than 300 g/l.

21. A process as claimed in claim 20, wherein said belt photoreceptor is an organic photoreceptor.

22. A process as claimed in claim 20, wherein said cleaning member is a blade.

23. A process as claimed in claim 20, wherein said spherical silica fine particles have a minor axis to major axis ratio of 0.8 or more and a degree of sphericity Ψ of 0.6 or more.

24. A process as claimed in claim 20, wherein said spherical silica fine particles have a minor axis to major axis ratio of 0.9 or more and a degree of sphericity Ψ of 0.8 or more.

25. A process as claimed in claim 20, wherein said spherical silica fine particles have an average particle size of from 0.05 to 3.0 μm.

26. A process as claimed in claim 20, wherein said spherical fine silica particles have an average particle size of from 0.1 to 1.0 μm.

* * * * *